US010945084B2

(12) United States Patent
Lawand et al.

(10) Patent No.: US 10,945,084 B2
(45) Date of Patent: Mar. 9, 2021

(54) PERSONAL HEARING DEVICE

(71) Applicant: Sonion Nederland B.V., Hoofddorp (NL)

(72) Inventors: Nishant Lawand, Hoofddorp (NL); Caspar Titus Bolsman, Hoofddorp (NL); Laurens de Ruijter, Hoofddorp (NL); Petrus Egbertus Henricus Hermsen, Hoofddorp (NL); Erik Marinus Krom, Hoofddorp (NL); Theodorus Geradus Maria Brouwer, Hoofddorp (NL); René Maas, Hoofddorp (NL)

(73) Assignee: SONION NEDERLAND B.V., Hoofddorp (NL)

( * ) Notice: Subject to any disclaimer, the term of this patent is extended or adjusted under 35 U.S.C. 154(b) by 0 days.

(21) Appl. No.: 16/160,310

(22) Filed: Oct. 15, 2018

(65) Prior Publication Data

US 2019/0116436 A1 Apr. 18, 2019

(30) Foreign Application Priority Data

Oct. 16, 2017 (EP) ..... 17196716

(51) Int. Cl.
*H04R 25/00* (2006.01)
*H04R 1/10* (2006.01)

(52) U.S. Cl.
CPC ..... *H04R 25/604* (2013.01); *H04R 1/1016* (2013.01); *H04R 1/1041* (2013.01); *H04R 25/48* (2013.01); *H04R 25/65* (2013.01); *H04R 2460/11* (2013.01)

(58) Field of Classification Search
CPC .. H04R 25/604; H04R 25/65; H04R 2460/11; H04R 25/48; H04R 25/40
See application file for complete search history.

(56) References Cited

U.S. PATENT DOCUMENTS

| | | | |
|---|---|---|---|
| 4,893,655 | A | 1/1990 | Anderson |
| 5,222,050 | A | 6/1993 | Marren et al. |
| 5,984,269 | A | 11/1999 | Short, III |
| 6,512,435 | B2 | 1/2003 | Van Namen |

(Continued)

FOREIGN PATENT DOCUMENTS

| | | | |
|---|---|---|---|
| CN | 101674509 | A | 3/2010 |
| CN | 101771910 | A | 7/2010 |

(Continued)

OTHER PUBLICATIONS

U.S. Appl. No. 16/160,091, filed Oct. 15, 2018, C. Bolsman, A Valve, a Transducer Comprising a Valve, a Hearing Device and a Method.

(Continued)

*Primary Examiner* — Tuan D Nguyen
(74) *Attorney, Agent, or Firm* — Nixon Peabody LLP

(57) ABSTRACT

A personal hearing device with an outer housing and a sound path with a length of 1-24 mm, a diameter of 0.5-6 mm, a roll of frequency of at least 500 Hz and with a valve configured to open and close the sound path. The sound path has suitable acoustical properties to act as a sound passage for open/closed hearing aids or hearables. The valve is selected to have a small influence on the acoustical properties of the remaining portions of the sound path.

18 Claims, 12 Drawing Sheets

(56) References Cited

U.S. PATENT DOCUMENTS

| | | | |
|---|---|---|---|
| 6,549,635 | B1 | 4/2003 | Gebert |
| 6,639,496 | B1 | 10/2003 | Van Namen |
| 6,788,796 | B1 | 9/2004 | Miles |
| 6,831,577 | B1 | 12/2004 | Furst |
| 6,853,290 | B2 | 2/2005 | Jorgensen |
| 6,859,542 | B2 | 2/2005 | Johannsen |
| 6,888,408 | B2 | 5/2005 | Furst |
| 6,914,992 | B1 | 7/2005 | van Halteren |
| 6,919,519 | B2 | 7/2005 | Ravnkilde |
| 6,930,259 | B1 | 8/2005 | Jorgensen |
| 6,943,308 | B2 | 9/2005 | Ravnkilde |
| 6,974,921 | B2 | 12/2005 | Jorgensen |
| 7,008,271 | B2 | 3/2006 | Jorgensen |
| 7,012,200 | B2 | 3/2006 | Moller |
| 7,062,058 | B2 | 6/2006 | Steeman |
| 7,062,063 | B2 | 6/2006 | Hansen |
| 7,072,482 | B2 | 7/2006 | Van Doorn |
| 7,088,839 | B2 | 8/2006 | Geschiere |
| 7,110,560 | B2 | 9/2006 | Stenberg |
| 7,136,496 | B2 | 11/2006 | van Halteren |
| 7,142,682 | B2 | 11/2006 | Mullenbom |
| 7,181,035 | B2 | 2/2007 | van Halteren |
| 7,190,803 | B2 | 3/2007 | van Halteren |
| 7,206,428 | B2 | 4/2007 | Geschiere |
| 7,221,767 | B2 | 5/2007 | Mullenbom |
| 7,221,769 | B1 | 5/2007 | Jorgensen |
| 7,227,968 | B2 | 6/2007 | van Halteren |
| 7,239,714 | B2 | 7/2007 | de Blok |
| 7,245,734 | B2 | 7/2007 | Niederdraenk |
| 7,254,248 | B2 | 8/2007 | Johannsen |
| 7,286,680 | B2 | 10/2007 | Steeman |
| 7,292,700 | B1 | 11/2007 | Engbert |
| 7,292,876 | B2 | 11/2007 | Bosh |
| 7,336,794 | B2 | 2/2008 | Furst |
| 7,376,240 | B2 | 5/2008 | Hansen |
| 7,403,630 | B2 | 7/2008 | Jorgensen |
| 7,415,121 | B2 | 8/2008 | Mögelin |
| 7,425,196 | B2 | 9/2008 | Jorgensen |
| 7,460,681 | B2 | 12/2008 | Geschiere |
| 7,466,835 | B2 | 12/2008 | Stenberg |
| 7,492,919 | B2 | 2/2009 | Engbert |
| 7,548,626 | B2 | 6/2009 | Stenberg |
| 7,657,048 | B2 | 2/2010 | van Halteren |
| 7,684,575 | B2 | 3/2010 | van Halteren |
| 7,706,561 | B2 | 4/2010 | Wilmink |
| 7,715,583 | B2 | 5/2010 | Van Halteren |
| 7,728,237 | B2 | 6/2010 | Pedersen |
| 7,809,151 | B2 | 10/2010 | Van Halteren |
| 7,822,218 | B2 | 10/2010 | Van Halteren |
| 7,899,203 | B2 | 3/2011 | Van Halteren |
| 7,912,240 | B2 | 3/2011 | Madaffari |
| 7,946,890 | B1 | 5/2011 | Bondo |
| 7,953,241 | B2 | 5/2011 | Jorgensen |
| 7,961,899 | B2 | 6/2011 | Van Halteren |
| 7,970,161 | B2 | 6/2011 | van Halteren |
| 8,098,854 | B2 | 1/2012 | van Halteren |
| 8,101,876 | B2 | 1/2012 | Andreasen |
| 8,103,039 | B2 | 1/2012 | van Halteren |
| 8,160,290 | B2 | 4/2012 | Jorgensen |
| 8,170,249 | B2 | 5/2012 | Halteren |
| 8,189,804 | B2 | 5/2012 | Hruza |
| 8,189,820 | B2 | 5/2012 | Wang |
| 8,223,996 | B2 | 7/2012 | Beekman |
| 8,233,652 | B2 | 7/2012 | Jorgensen |
| 8,259,963 | B2 | 9/2012 | Stenberg |
| 8,259,976 | B2 | 9/2012 | van Halteren |
| 8,259,977 | B2 | 9/2012 | Jorgensen |
| 8,280,082 | B2 | 10/2012 | van Halteren |
| 8,284,966 | B2 | 10/2012 | Wilk |
| 8,313,336 | B2 | 11/2012 | Bondo |
| 8,315,422 | B2 | 11/2012 | van Halteren |
| 8,331,595 | B2 | 12/2012 | van Halteren |
| 8,369,552 | B2 | 2/2013 | Engbert |
| 8,379,899 | B2 | 2/2013 | van Halteren |
| 8,509,468 | B2 | 8/2013 | van Halteren |
| 8,526,651 | B2 | 9/2013 | Lafort |
| 8,526,652 | B2 | 9/2013 | Ambrose |
| 8,798,304 | B2 | 8/2014 | Miller |
| 2009/0285437 | A1 | 11/2009 | Takigawa et al. |
| 2010/0061582 | A1* | 3/2010 | Takigawa ..... H04R 1/1041 381/380 |
| 2010/0061852 | A1 | 3/2010 | Takigawa et al. |
| 2010/0166245 | A1 | 7/2010 | Takigawa et al. |
| 2011/0129108 | A1 | 6/2011 | Miller |
| 2011/0182453 | A1 | 7/2011 | van Hal |
| 2011/0189880 | A1 | 8/2011 | Bondo |
| 2011/0268292 | A1 | 11/2011 | Suvanto et al. |
| 2011/0299708 | A1 | 12/2011 | Bondo |
| 2011/0299712 | A1 | 12/2011 | Bondo |
| 2011/0311069 | A1 | 12/2011 | Ambrose |
| 2012/0014548 | A1 | 1/2012 | van Halteren |
| 2012/0027245 | A1 | 2/2012 | van Halteren |
| 2012/0140966 | A1 | 6/2012 | Mocking |
| 2012/0155683 | A1 | 6/2012 | van Halteren |
| 2012/0155694 | A1 | 6/2012 | Reeuwijk |
| 2012/0255805 | A1 | 10/2012 | van Halteren |
| 2013/0028451 | A1 | 1/2013 | de Roo |
| 2013/0136284 | A1 | 5/2013 | van Hal |
| 2013/0142370 | A1 | 6/2013 | Engbert |
| 2013/0163799 | A1 | 6/2013 | Van Halteren |
| 2013/0195295 | A1 | 8/2013 | van Halteren |
| 2013/0266170 | A1* | 10/2013 | Yamagishi ..... H04R 1/2857 381/353 |
| 2013/0343564 | A1* | 12/2013 | Darlington ..... H04R 1/1083 381/74 |
| 2014/0169603 | A1 | 6/2014 | Sacha |
| 2014/0305735 | A1 | 10/2014 | Van Halteren |
| 2016/0255433 | A1 | 9/2016 | Grinker |
| 2017/0208382 | A1 | 7/2017 | Grinker |
| 2017/0251292 | A1 | 8/2017 | Wiederholtz |
| 2017/0360614 | A1* | 12/2017 | Ely ..... A61F 11/08 |

FOREIGN PATENT DOCUMENTS

| | | | |
|---|---|---|---|
| CN | 102595270 | A | 7/2012 |
| CN | 106982400 | A | 7/2017 |
| EP | 1 840 869 | A1 | 10/2007 |
| EP | 2071872 | A1 | 6/2009 |
| EP | 2134107 | A2 | 12/2009 |
| EP | 2164277 | A2 | 3/2010 |
| EP | 2345259 | A2 | 7/2011 |
| EP | 2 747 455 | A2 | 6/2014 |
| EP | 3177037 | A2 | 6/2017 |
| WO | 2007099893 | A1 | 9/2007 |
| WO | WO 2010/042613 | A2 | 4/2010 |
| WO | 2014/030998 | A1 | 2/2014 |
| WO | 2019052714 | A1 | 3/2019 |
| WO | 2019052715 | A1 | 3/2019 |

OTHER PUBLICATIONS

U.S. Appl. No. 16/160,214, filed Oct. 15, 2018, N. Lawand, A Sound Channel Element with a Valve and a Transducer with the Sound Channel Element.

Partial European Search Report for Application No. EP 18200516, dated Feb. 20, 2019 (5 pages).

Extended European Search Report for Application No. 18200513.2, dated Feb. 22, 2019 (4 pages).

Cox, R.M.; "Acoustic aspects of hearing aid-ear canal coupling systems"; Monographs in Contemporary Audiology, vol. 1, No. 3, pp. 1-44; Mar. 1, 1979; XP007905558 (48 pages).

* cited by examiner

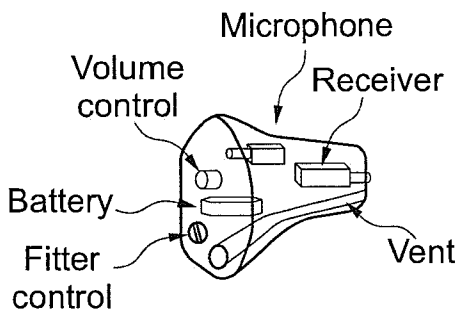

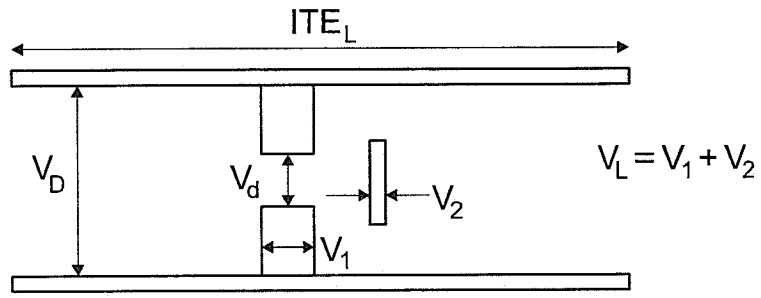

| ITE length (ITE$_L$) (mm) | Vent Dia. ($V_D$) (mm) | Roll of frequency (Openness) without valve (Hz) | Valve Dia. ($V_d$) (mm) | Valve Length ($V_L$) (mm) (Maximum) | Roll of frequency (Openness) with a valve, system is 80% open with the valve (Hz) | Acoustic impedance (Valve + Vent) (Kg/m$^4$) |
|---|---|---|---|---|---|---|
| 16 | 2 | 649 | 1 | 2.5 | 520 | 6866.541 |
| 10 | 2 | 800 | 1 | 1.6 | 640 | 10387.84 |
| 22 | 2 | 562 | 1 | 3.0 | 450 | 13909.15 |

| ITE length (ITE$_L$) (mm) | Vent Dia. ($V_D$) (mm) | Openness Without valve (Hz) | Valve Dia. ($V_d$) (mm) | Valve Length ($V_L$) (mm) (Maximum) | Openness with the valve, system is 90 % open with the valve (Hz) | Acoustic impedance (Valve + Vent) (Kg/m$^4$) |
|---|---|---|---|---|---|---|
| 16 | 2 | 649 | 1 | 1.0 | 585 | 5425.415 |
| 10 | 2 | 800 | 1 | 0.7 | 720 | 8207.679 |
| 22 | 2 | 562 | 1 | 1.4 | 505 | 10989.94 |

Fig. 22

PERSONAL HEARING DEVICE

The present invention relates to a personal hearing device with an outer housing and a sound or vent channel therein and a valve for closing the sound/vent channel.

Often, in hearing aids, hearables, ear phones, ear buds or the like, sound is desired from the outside of the element while, at other points in time, it is desired that no sound is able to pass the hearable, such as when listening to music, as a vent will allow sound to pass in both directions and thus will also allow sound generated by the hearable to escape instead of impinging on the ear drum.

Vents and the like may be seen in US2011/0129108, US2017/0251292, US2014/0169603, U.S. Pat. Nos. 5,984,269, 6,639,496, 8,798,304, 6,512,435, 6,549,635, US2016/0255433, US2017/0208382, EP3177037 and U.S. Pat. No. 4,893,655.

In a first aspect, the invention relates to a personal hearing device comprising:

an outer housing, a sound path in the outer housing, the sound path extending through the outer housing from a first opening to a second opening, a valve configured to open and close the first opening, the second opening and/or the sound path, where the sound path has a length of 1-24 mm, a 0.28-19.6 mm2 and a roll of frequency of at least 500 Hz.

In the present context, a personal hearing device may be a hearing aid, an ear bud, an ear phone, a hearable or the like. Usually, the personal hearing device has a portion, with the cuter housing, which is to be positioned in or at the ear of a person, such as in or at an ear canal of the person. Thus, the outer housing usually has rather strict requirements as to its dimensions. For housings to be positioned in an ear canal, a largest dimension often is 8-18 mm, whereas for positioning in an ear, the largest dimension often is no more than 24 mm.

In many situations, the outer housing is personalized, such as adapted to a particular ear or ear canal. Such personalization may be to create a mould after the ear or ear canal to ensure that the housing has a shape corresponding to that particular ear or ear canal.

Also, acoustic properties of the sound path may be adapted to the particular ear or ear canal or to the particular person, such as a hearing problem of the person. Thus, in addition to the opening or closing of the sound path, additional adaptation may be desired.

The sound path extends through the outer housing in order to allow sound to pass through the housing. In many situations, the housing will be configured or dimensioned to fit the ear or ear canal to a degree where sound is not able to pass it. So, to allow sound to pass, the housing has the sound path inside the housing. In some situations, the housing may actually have a shape allowing sound to pass a portion thereof, such as if the housing is fastened in the ear or ear canal with a resilient element, often called a dome. Then, the dome may be the element preventing sound from passing from the outside to the ear drum. Domes may be provided "open" and thus allowing sound to pass, but using an "open" dome then will not allow the preventing of sound from the outside of the ear to reach the ear drum. Using a "closed" dome will prevent this, but then, the housing may have the sound path inside the housing at least from the front side of the dome to the back side thereof.

The openings preferably are in the outer housing but may be in elements attached to the outer housing. In one example, a spout or nozzle is attached to the outer housing. A spout/nozzle may be used for attaching a sound guide, such as a tube, to the housing, especially when the housing also comprises a sound generator, often called a receiver in the hearing aid industry. A nozzle may also be used for attaching the outer housing to elements, such as domes, or generally to guide sound to or away from the outer housing. When a dome is attached to a nozzle attached to the housing, the sound path may extend at least partly in the nozzle so that the opening(s) may be provided in the nozzle.

Thus, the first and/or second openings may be provided in diametrically positioned areas (inner-most and outer-most portions for example) of the device, or one or both may be provided in a top portion, side portion or the like.

In some embodiments, that of the first and second openings which is configured to be the closest to a person's ear drum, may be configured to be positioned just before the bony area of the ear. This may entail dimensioning and/or shaping the outer housing to allow this.

Naturally, the sound path is dimensioned to allow sound to be guided by it. A popular quantification of the properties of a sound path is the acoustic impedance thereof. The acoustic impedance relates to both the length of the sound path and the cross section thereof. Presently, the sound path has a length of 1-24 mm and a diameter of 0.6-5 mm.

As will be described further below, the sound channel may act as a low pass filter. The roll of frequency of this filter is the frequency at which a 3 dB loss is seen. Thus, the higher the roll of frequency, the higher frequencies are transported by the sound channel. Usually, the attenuation for frequencies above the roll of frequency is 12 dB per octave. According to the invention, the roll of frequency is 500 Hz or more. In this situation, the device is well suited for use in e.g. a hearing aid to allow frequencies below the roll of frequency to escape from the sound emitted by the hearing aid receiver, so that this sound is high pass filtered to allow frequencies in which voice is seen to reach the ear drum.

Clearly, a roll of frequency of this type cannot be (see below) obtained by a long and very narrow sound passage. Preferably, the sound path has:

a length of 1-12 mm and a cross section of 0.28-10 $mm^2$ a length 12-24 mm and a cross section of 10-19.6 $mm^2$ or a length of 8-16 mm and a cross section of 5-15 $mm^2$.

In the present context, a valve may be an element which may be used for controlling sound, through the sound path. A valve may operate in different manners. Often, a valve defines an aperture, which may be the first or second opening or a portion of the sound path between the openings, which aperture is closed or allowed to be open. Closing may be to block the aperture using e.g. a blocking element, or the sound path may be deformed, such as if the portion at the aperture is deformable (soft tube, for example), which may be compressed to become closed. This aperture may have a cross sectional area of 1 $mm^2$ or more, such as 2 $mm^2$ or more, such as 3 $mm^2$ or more, such as 4 $mm^2$ or more.

In this context, "open" and "closed" will depend on what is desired controlled. When controlling sound, the aperture need not be hermetically closed, as sound may be sufficiently attenuated even if the aperture still has a small opening. "Open" and "closed" may, for sound control, be defined to a desired degree of sound attenuation and/or in relation to a minimum and maximum size of the aperture when closed or not closed by the closing element.

"Closed" may mean that all frequencies within a predetermined interval, such as 20 Hz-20 kHz or 700-2000 Hz are attenuated at least 3 dB, such as at least 6 dB, such as at least 10 dB, such as at least 30 dB. "Closed" may additionally or alternatively mean that a cross sectional area of any opening between the closing element and the aperture has a cross section of no more than 0.157 $mm^2$, such as no more than 0.15 $mm^2$, such as no more than 0.125 $mm^2$, such as no more than 0.12 $mm^2$, such as no more than 0.1 $mm^2$, such as no more than 0.08 $mm^2$, such as no more than 0.05 $mm^2$, such as no more than 0.02 $mm^2$.

"Open" may mean that no frequency within a predetermined interval, such as 20 Hz-20 kHz or 700-2000 Hz is attenuated more than 6 dB, such as no more than 3 dB, such no more than 2 dB. "Open" may additionally or alternatively mean that a cross sectional area of the aperture or a portion thereof not blocked by the closing element, is at least 0.05 $mm^2$, such as at least 0.07 $mm^2$, such as at least 1 $mm^2$, such as at least 1.2 $mm^2$, such as at least 1.5 $mm^2$, such as at least 2 $mm^2$, such as at least 2.2 $mm^2$, such as at least 2.5 $mm^2$, such as at least 3 $mm^2$, such as at least 4 $mm^2$, such as at least 5 $mm^2$. The valve will only be one of "open" or "closed" at the same time but may shift between the states.

Preferably, the roll of frequency of the sound path, when the valve is open, is 200 Hz or more, such as 400 Hz or more, such as 600 Hz or more.

The length of the sound path may be a Euclidean distance between the two openings, such as between centres of the openings. The length may alternatively be determined as a path which the sound takes between the two openings. If the sound is guided in a sound guide, such as a tube, the length of this guide/tube would define the length. If the sound is allowed to travel inside the housing between elements therein, such as receivers, microphones, electronics or the like, the path taken may be used for determining the length. In the situation where the sound takes multiple paths from the first to the second opening, the length may be the longest length, the shortest length, cr a mean value of the lengths.

The length is 1-24 mm, such as 5-24 mm, such as 18-24 mm, such as 20-24 mm, or 8-15 mm, such as 10-14 mm.

The cross section of the sound path also may be determined in a number of manners. Naturally, the sound path need not have a circular cross section along its entire length. Often, sound paths have portions, if not all of it, which do not have circular cross section. The acoustic properties, however, are not that much affected by the cross section of the sound path. Thus, the diameter of a portion of the sound path thus is a diameter defining an area (the corresponding circle) corresponding to, such as being identical to, a cross section of the sound path at that position. Naturally, the cross sectional area of the sound path may vary over the sound path, such as around the valve when in the open configuration.

The cross sectional area may be determined in a number of manners, such as in a plane perpendicular to a direction of the sound in a particular portion of the sound path. If the sound path is defined by an oblong element, the plane could be perpendicular to a direction of extension or longitudinal direction of the oblong element. However, the sound path may be curved, so that the cross sectional area may be determined for different portions of the path using different non-parallel planes.

Naturally, if the sound path comprises multiple sound paths from the first opening to the second opening (where portions of the sound path may be common and others not), the cross sectional area of each portion may be determined individually and then summed.

In a simple manner, the cross sectional area may be determined along the sound path in a plane perpendicular to a straight line from the first opening to the second opening. Thus, the sound path or paths, if multiple are defined, may be defined in any plane and the area thereof determined and converted into a corresponding diameter.

Naturally, the diameter of the sound path may be a mean diameter over the complete sound path or a portion thereof not at the valve. Alternatively, the diameter may be a minimum diameter of all portions of the sound path or all portions of the sound path not at or around the valve.

The cross sectional area is 0.28-19.6 $mm^2$ which, for a circular sound path, corresponds to diameter of 0.5-6 mm. Preferably, the cross sectional area is 1.9-7.1 $mm^2$ corresponding to a diameter of 1-3 mm. The cross sectional area may be 0.28-10 $mm^2$, 1-5 $mm^2$, 3-10 $mm^2$, 5-12 $mm^2$, 8-16 $mm^2$, 5-15 $mm^2$, 8-17 $mm^2$. 10-19 $mm^2$, or 15-19 $mm^2$ where the length may then be selected to arrive at the desired roll of frequency.

In one embodiment, the valve comprises a closing member and an actuator configured to bring the closing member to a first position closing the sound path and a position second position allowing the valve to be open. In one situation, the actuator is not provided in the sound path so that the only element interfering with the sound is the closing member. In other embodiments, the actuator or a portion thereof is provided in the sound path and thus may interfere with the sound when the valve is in the open position.

Preferably, the portions of the valve, i.e. the closing member and any portions of the actuator, present in the sound path have a combined, predetermined length being 3 mm or less.

The skilled person knows that in a sound tube with a predetermined inner diameter, an element with a lower inner diameter may not alter the acoustic properties too much, if the narrower diameter is for a short length only. Thus, it is preferred that the elements of the valve in the sound path are present within a maximum distance or length of 3 mm. Thus, preferably, the largest distance between any portions of the valve elements is 3 mm or less. This distance may be a Euclidian distance between the two portions of the valve elements or portions in the sound path. Alternatively, the distance may be a distance along the sound path, so that the sound encountering one extreme portion travels 3 mm or less, before it encounters the other extreme portion. Preferably, this length is even smaller, such as 2 mm or less, such as 1 mm or less. The smaller this distance is the lower is the impact of the narrowing on the acoustic properties defined by the remainder of the sound path.

Another interesting feature is the cross sectional area of the sound path at the valve (in the open configuration). This cross sectional area preferably is at least 25%, such as at least 30%, such as at least 40%, such as at least 50%, such as at least 60%, such as at least 70%, such as at least 80% of a mean cross section of the portions of the sound path not at the valve (portions on one or either side of the portions of the sound path comprising the closing member and any portion of the actuator).

In one embodiment, the actuator is positioned outside of the sound path. In another embodiment, a portion of the actuator is positioned in the sound path and another part is positioned in the sound path. In a third embodiment, the actuator is positioned in the sound path.

When the actuator or a part thereof is positioned in the sound path, the above maximum extent along the sound path direction and the cross sectional are will define how large the actuator can be.

The actuator or part thereof thus will have a cross sectional area which fits inside that of the sound path at the same position. This cross sectional area of the actuator (part)

may have a central opening therein allowing sound to pass or openings at its periphery with that function.

As mentioned, one manner of closing the sound path is to deform it, such as to compress it. However, it is preferred to provide a closing element which is configured to close an aperture of the sound path when in the first position. Thus, the closing element is preferably configured to abut the aperture at least at a large proportion of a circumference of the aperture, such as at at least substantially the entire circumference of the aperture.

Naturally, the aperture may have any shape, such as oval, circular or the like. The aperture may comprise a number of apertures if desired, where the closing element then may be configured to block or close all apertures when in the first position. An aperture may be formed in a straight or plane element, such as a wall or plane surface. Alternatively, the aperture may be provided in a bent or curved element, such as in a wall of a tube or channel. Then, the closing element should be shaped to conform to at least substantially that shape in order to be able to close the aperture sufficiently.

In the second position, the closing element does not close the aperture. Depending on the requirements, the closing element may still cover the aperture partially or not at all. Additional positions of the closing element may be defined in which the aperture is only partially closed if desired.

The closing element may be movable, such as translatable, rotatable, bendable or combinations thereof in order to transfer from the first to the second position or vice versa. Often, the aperture is provided in a sound channel, where the first and second positions are positions at different positions along the longitudinal direction of the sound channel, sc that a simple translation along the longitudinal direction may transfer the closing element from the first to the second position and vice versa. Naturally, the movement may be in any direction, such as perpendicular to the sound channel.

In one embodiment, the aperture to be closed may be formed by an inner surface of a channel, such as a tube, where the closing may be a deformation of the channel/tube, so that the closing element may be a part of the channel/tube.

The actuator preferably has the function of bringing the closing element from the first position to the second position or vice versa. This may be obtained by deflecting the armature and thus, via the drive portion, move the closing element.

In one embodiment, the valve is positioned close to that of the openings which is configured to be the closest to the person's eardrum. However, the valve may be provided at any position of the sound path and at the first/second openings. The valve, or at least the closing member thereof, may in fact be provided outside of the housing if desired.

Also, the actuator of the valve may be positioned away from the closing member. A number of manners exist for transporting movement/force/torque from the actuator to the closing member, such as around other elements in the outer housing, if desired.

Naturally, multiple valves may be provided if desired. Also, multiple sound paths may be provided which may be controlled by one valve or by a multiple of valves. Thus, different sound paths may have different properties and may be opened independently of each other to arrive at a device with different properties.

A valve may also have additional properties than merely opening or closing the sound path. A valve may have one or more intermediate positions where the sound path is partly open, such as where different cross sectional areas are provided at the closing member. This again will affect the acoustic properties of the vent and thus provide the vent with additional functionalities than just on/off.

The device may further comprise a filter for preventing foreign objects from entering or blocking the sound path. This filter may comprise a grid, an open foam or a flap, for example. Preferably, this filter is positioned in or at openings of the sound path to surroundings of the device.

In a preferred embodiment, the device further comprises a sound emitter positioned in the outer housing, where the outer housing has a sound output configured to output sound from the sound emitter. Naturally, multiple sound emitters may be provided, such as for different frequency intervals (woofer/tweeter for example). In fact, if multiple emitters are provided, each may have a sound output controlled by a valve, or multiple/all may have an output controlled by a valve.

In one embodiment, the outer housing has a sound output element, often called a spout or nozzle, configured to, such as positioned to, receive sound from the sound emitter(s).

In one embodiment, this sound output element forms part of the sound path, so that the sound from the outside will also travel through the sound output element. Then, the sound output element may comprise a single channel shared by the sound path and the sound from the emitter(s), or multiple channels may be used for separating the sound path from the sound from the emitter(s)—at least for a portion of a length of the sound output element. In one embodiment, the sound from the emitter and that from the sound path exits the sound output element through a common opening and via a common volume of the sound output element.

When the sound path extends through the sound output element, an opening may be provided between a portion of the sound path in the outer housing and the portion extending in the sound output element. Also, the second opening may be an opening of the sound output element. Also, the valve or the aperture of the valve may be provided in the sound output element. This is an advantage, as this is usually positioned closer to the intended position of the persons ear drum than the outer housing. Actually, the aperture may be positioned at the output opening of the sound output element to be as close to the eardrum as possible.

Naturally, the sound path may be defined by a separate element, such as a tube, extending in the outer housing, but this element will take up space. Thus, in one embodiment, the sound emitter has an outer surface defining at least a part of the sound path. Thus, the sound path or at least a portion thereof is not formed by a separate tube or the like but finds its way around the usual elements in the outer housing, such as the sound emitter, any microphone(s), battery, or the like.

In one embodiment, the valve comprises an actuator for driving the closing element between the first and second positions, the actuator, and optionally also any closing element, being positioned, when projected on to a straight line through the sound emitter and the sound output, between the sound emitter and the sound output. Usually, the cross section of the sound emitter is larger than that of the actuator, which again is larger than that of the sound channel. Then, the actuator does not add to the thickness of the device which is usually defined by the sound emitter. This position of the actuator may add to the length, however, of the device. Thus, the device may be generally oblong and have a cross sectional area, perpendicular to the oblong direction, not much larger than that of the sound emitter, such as no more than 50% more, such as no more than 40% more, such as no more than 30% more, such as no more than 20% more, such as no more than 10% more.

In addition or alternatively, an inner surface of the outer housing may define at least a part of the sound path.

In one embodiment, as described, the cuter housing has a first and a second at least substantially opposite side surfaces, where the first opening is provided in the first side surface and the second opening is positioned in the second surface. Alternatively, one opening may be at the top of the housing. Also, an opening may be provided in a sound output element.

In one embodiment, the device comprises a fixing element, such as a dome, configured to attach the device in relation to an ear or ear canal, where the first opening is provided on one side of the fixing element and the other opening on the other side of the fixing eiement, where the fixing element is configured to not allow sound to pass the device between the device and the ear or ear canal. Then, the fixing element may be a so-called closed dome which has no sound openings between a side thereof facing the ear drum and an opposite side thereof.

A large amount of valve types are suitable for use in the device. Interesting valve types may be seen in Applicants applications filed on even date titled "A CHANNEL ELEMENT WITH A VALVE AND A TRANSDUCER WITH THE SOUND CHANNEL ELEMENT" and "A VALVE, A TRANSDUCER COMPRISING A VALVE, A HEARING DEVICE AND A METHOD" filed on even date and which are hereby incorporated by reference.

In one embodiment, the sound path comprises:

a first sound path part extending in a first direction and a second sound path part extending in a second direction, the second direction being at an angle to the first direction, where the valve has a closing element configured to be moved from a first position in which the closing element is adjacent to, such as parallel to, a wall portion of the second sound path and a second position where the closing portion blocks the first sound path.

In this embodiment, the closing element is adjacent to the wall portion in the open position, whereby the closing element need not take up too much space in the second sound path part. Thus, the second sound path part may remain open and thus not affect the acoustic properties of the valve in the open position.

Also, the movement of the closing element may be rather simple, as it may be a translation and/or a rotation which is easily provided using e.g. magnetic attraction cr a lever of an actuator.

In one situation, the valve comprises means, such as an actuator, for translating the closing element from the first to the second position.

In another situation, the valve comprises means, such as an actuator, for rotating the closing element from the first to the second position.

A number of manners of obtaining this is possible. The actuator may be provided fully cr partly in the first sound path part and/or the second sound path part or not at all. The actuator may be provided outside of the sound path all together, such as in a wall portion or element forming a part of the sound path.

In one situation, the second sound path part has a circular cross section, where the closing element then may be rotated around an axis of the second sound path part between the first and second positions.

Alternatively, the closing element may be translated along a longitudinal axis or sound direction in the second sound path part. Then, the closing element may in principle have any shape, but a shape is preferred mirroring a shape of a portion of the inner surface of the second sound path part at an interface between the first and second sound path parts (where the aperture will be), so as to be able to block the first sound path part at this position. Also, the closing element will, in the first position, be conform to the inner shape of the second sound path part and thus may be adjacent to this wall portion to not take up too much space in the second sound path part.

Other manners of providing the valve may be to provide a rotatable flap in the sound path, where, in the closed configuration, the flap closes the sound path and in the open configuration, the flap extends at least substantially in a direction of the sound to allow sound to pass it.

Another valve type in one where the closing element in the first position is positioned in a wall portion of the sound path. Thus, in the open position, the closing element is not positioned in the sound path. This may be a situation where the closing element acts as a sliding door and disappears in the wall when not needed.

Preferably, the valve comprises the actuator for driving the closing element between the positions where, in a first position, it closes the sound path and, in a second position, allows the sound passage to be open. Preferably, the actuator, or at least a portion thereof, is positioned outside of the sound path. Then, the actuator or closing element may have an element extending from the actuator, or a portion thereof outside of the sound path, to the closing element, such as a drive element.

The actuator proper may be outside of the sound path where a drive element may transfer force or torque to the closing element provided in the sound path.

Alternatively, a portion of the actuator may be in the sound path, such as when the actuator comprises a magnetic drive where a portion thereof is connected to, or may itself form, the closing element and another part is fastened to, such as form a part of, the outer housing and/or the sound output element. A magnetic drive may comprise a combination of a magnet and a coil or a magnetisable material. Naturally, a magnet may be permanent cr an electromagnet. A magnetisable material will, in the presence of a magnet, itself form a magnet. The coil may act as a magnet and thereby apply a force to another magnet or a magnetisable material. This force may be used for moving the closing element, when the closing element has one of a magnet, coil or magnetisable element and where the another coil/magnet/magnetisable element is another part of the actuator and may be fastened to or form part of the outer housing or sound output element. A set-up of this type may be termed a moving magnet set-up, as it is often desired that the stationary part has a coil and the moving part, here the closing element, comprises or is a magnet. Naturally, the opposite, then called a moving coil set-up, may be used if desired.

Another type of actuator may be a so-called balanced armature actuator having an armature leg extending through a magnet gap and a coil, where a current fed to the coil controls the deflection of the armature leg. In historic valves based on this technology, the sound path extends through the actuator itself, whereby the sound will be influenced by the tortuous path inside the actuator. Preferably, the sound path according to the invention extends outside of the actuator, so that the actuator is positioned outside of the sound path. Then, the actuator has an opening through which a drive portion extends which conveys force/torque from the armature to the closing element, so that the closing element may be positioned outside the actuator housing. Then, the sound to be controlled by the valve may flow outside of the housing and not, at least to any significant degree, in the actuator housing.

The actuator housing may have additional openings if desired, such as an opening for receiving a current to be fed to the drive coil. Preferably, the housing has no additional openings or no additional openings which are "open" within the above definition.

The magnet gap preferably is a gap or tunnel in which a magnetic field exists. Often, magnet structures have one or more magnets for creating the magnetic field and additional elements, often called a yoke, configured to guide the magnetic field outside of the magnet gap. Usually, the magnet gap is formed between two adjacent and parallel surfaces between which a magnetic field exists.

The drive coil preferably is a coiled electrical conductor. A single conductor often is used, but a coil may comprise multiple conductors if desired. The coil preferably is configured to provide a magnetic field in a portion of the armature leg extending within the coil tunnel and the magnet gap so that the interaction of the magnetic fields will exert a force on the armature leg portion.

The coil tunnel may be a portion of the coil around which the windings of the coil are provided.

The armature preferably is an element configured to guide a magnetic field generated in the coil to a portion of the armature leg extending within the magnet gap. Often, armatures of this type are made of metal, such as Al, Ni, Fe, Mn, Cr or alloys thereof.

The armature comprises the deflectable armature leg and may comprise additional portions, such as portions configured to be fastened inside or to the housing in order to attach one end of the armature leg in relation to the housing. E-shaped armatures exist, as do U-shaped armatures and I-shaped armatures.

The armature leg is deflectable, whereby one end thereof may be moved when an opposite end is fixed. The armature leg may be made of a flexible material allowing the armature leg to bend. Alternatively or additionally, the armature leg may comprise a locally bendable portion, such as a narrowing, a neck portion or a hinge, around which the two extreme portions of the armature leg may bend.

The valve has a drive portion connected to the deflectable armature leg and extending through the opening to the closing element. Naturally, this drive portion may form a part of the armature leg or may be a separate part attached to or engaging the armature leg.

The drive portion may extend in a general direction of the armature leg so that the deflection of the armature leg will cause a movement of the drive portion but where the movement is amplified by the larger distance to any bending or rotating portion of the armature leg. A larger deflection or movement makes it possible to have the first and second positions farther from each other. Then, the aperture may be larger while still be fully opened and closed, or the distance between the closing element and the aperture may be made larger, creating a larger effective opening of the aperture.

In one embodiment, the first and second positions are positions with a relative distance of at least 0.1 mm, but preferably, the "stroke" of the movement is at least 0.3 mm, such as at least 0.5 mm, such as at least 1 mm, such as at least 1.5 mm. In situations where the valve is used in a hearable or hearing aid for creating both an open and a closed use scenario, i.e. where sound from the surroundings is allowed (or prevented from) to pass the hearable or hearing aid and impinge on the ear drum, it is desired that the valve opening is sufficiently large to actually allow sound to pass.

Naturally, the drive portion may be made of the same material as the armature leg, but this is not required. Thus, the drive portion may be made of e.g. a lighter material, as this may be require less force and thus energy to move.

The drive portion naturally may be fastened to an end portion of the armature leg but may alternatively be fastened to or extend from other portions of the armature leg. Preferably, the drive portion is fastened to or engages a part of the armature leg which moves in relation to the housing during deflection. Often, the larger movement the better.

In one embodiment, the drive portion extends from an end of the armature leg and generally away from the armature leg. This drive portion may extend parallel to the end of the armature leg or may be bent in relation to the direction of the armature lea in order to conform to a direction of the aperture to be closed.

Naturally, the drive portion may have a general direction at an angle to the armature leg, such as at least substantially perpendicular thereto, if desired.

The drive portion may have any extent, as it may be used for conveying movement and thus force/torque from the housing to the closing element which may be positioned at any position in relation to the housing. Thus, the drive portion may extend more than 2 mm away from the housing, such as more than 3 mm, 4 mm, 5 mm, 6 mm cr more if desired.

Often, the actuator housing is orientated so that the deflection of the armature leg corresponds to the desired movement of the closing element between the first and second positions.

In one situation, the closing element is formed by the drive portion. Thus, the drive portion may be not only positioned so as to be in the first and/or second positions and be moved there between during deflection of the armature leg, hut the shape and potentially other properties of the drive portion may make it suitable for closing/blocking/sealing the aperture. Other properties of the drive portion and thus closing element, compared to the desired materials of the armature leg, may relate to surface softness, sealing properties, weight, shape ability or the like.

In the following, preferred embodiments will be described with reference to the drawing, wherein.

Figure 7:
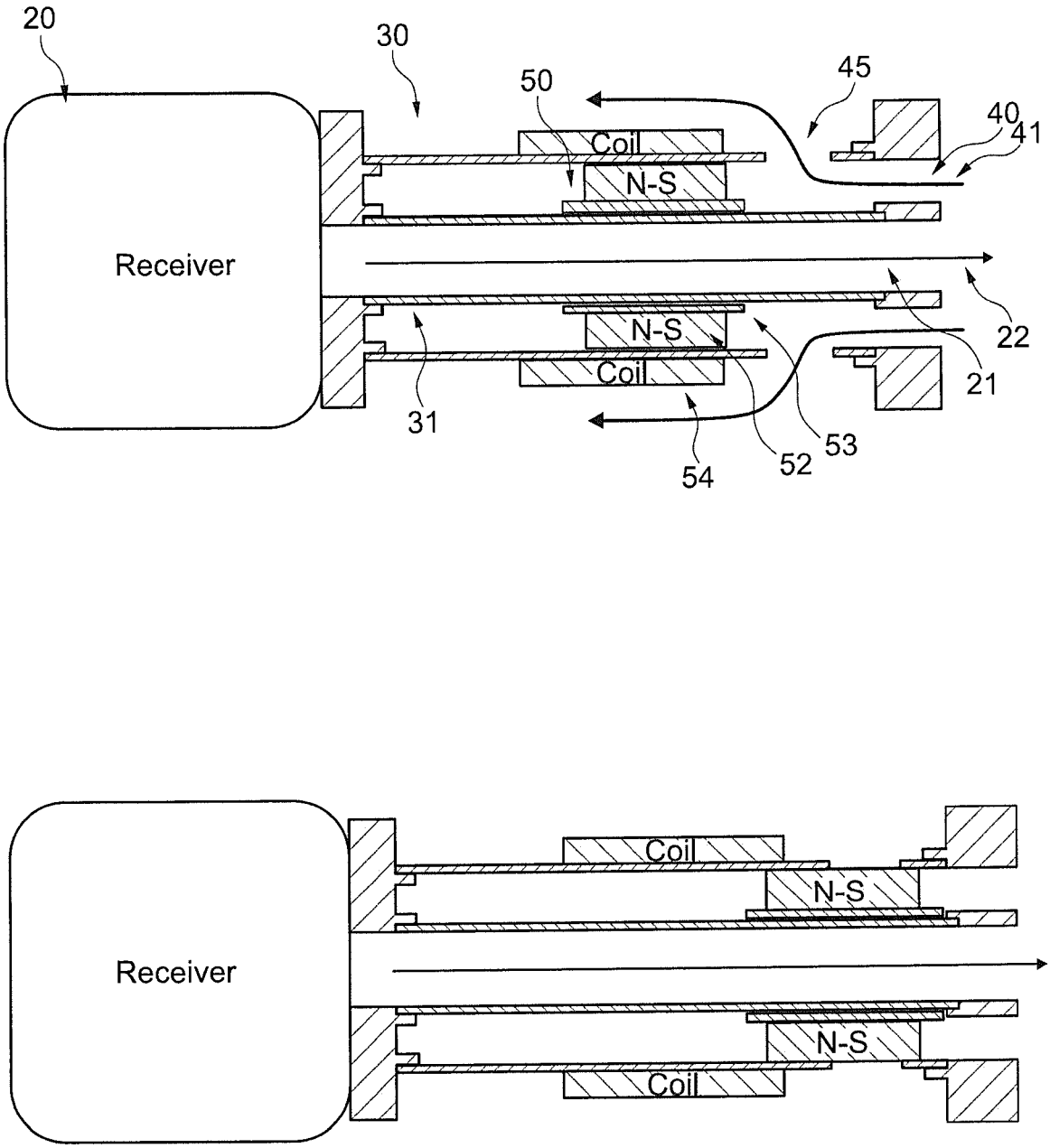
Figure 8:
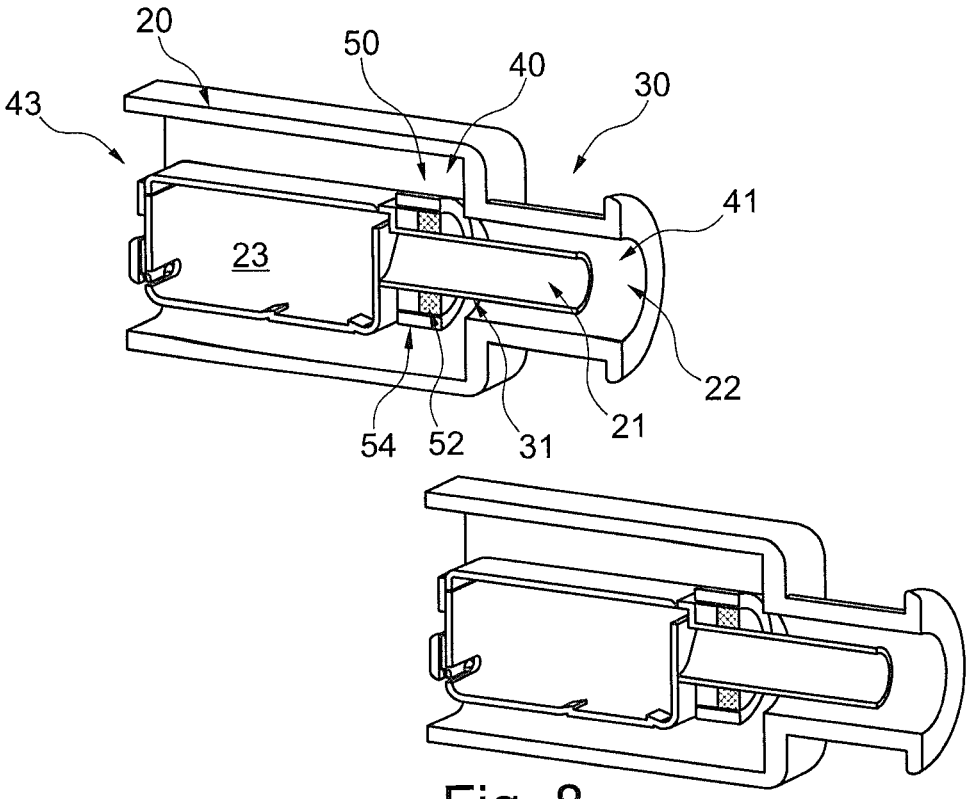
Figure 9:
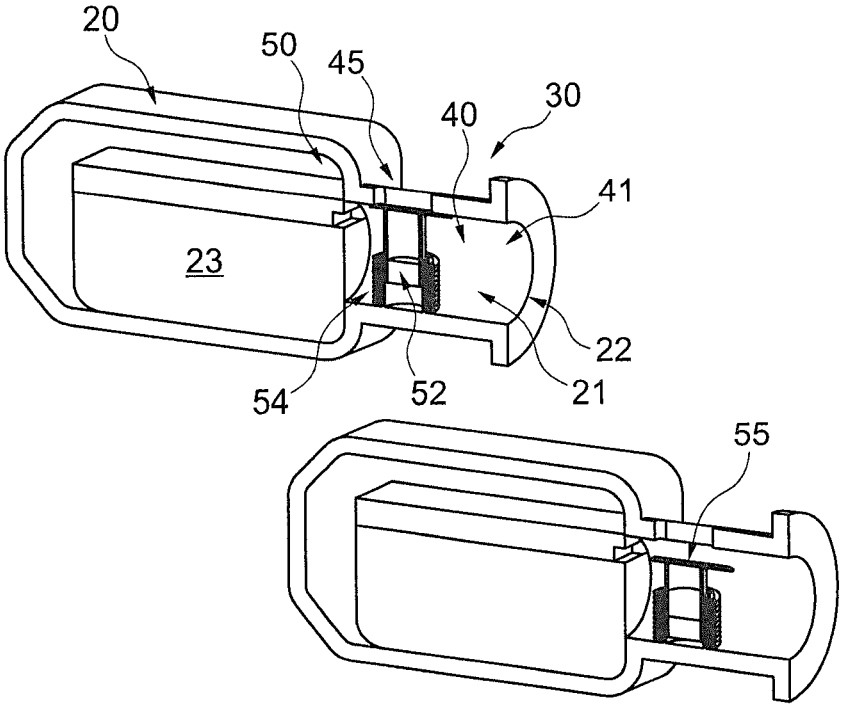
Figure 10:
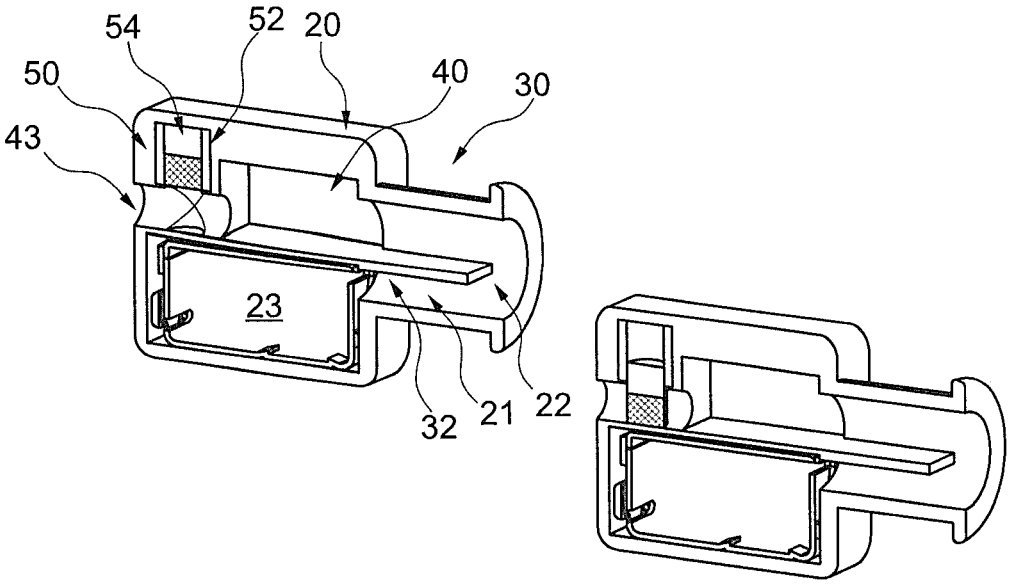
Figure 11:
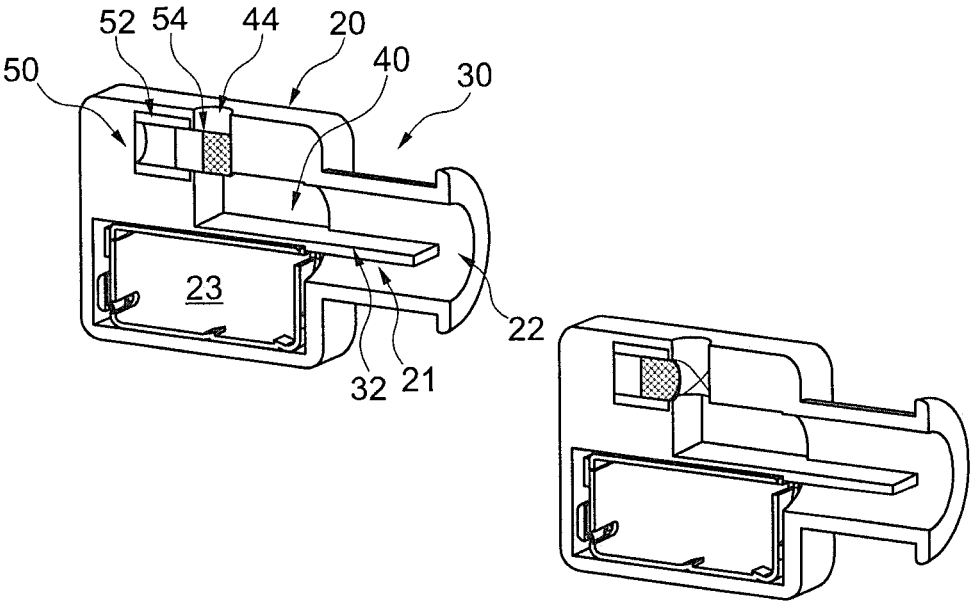
Figure 12:
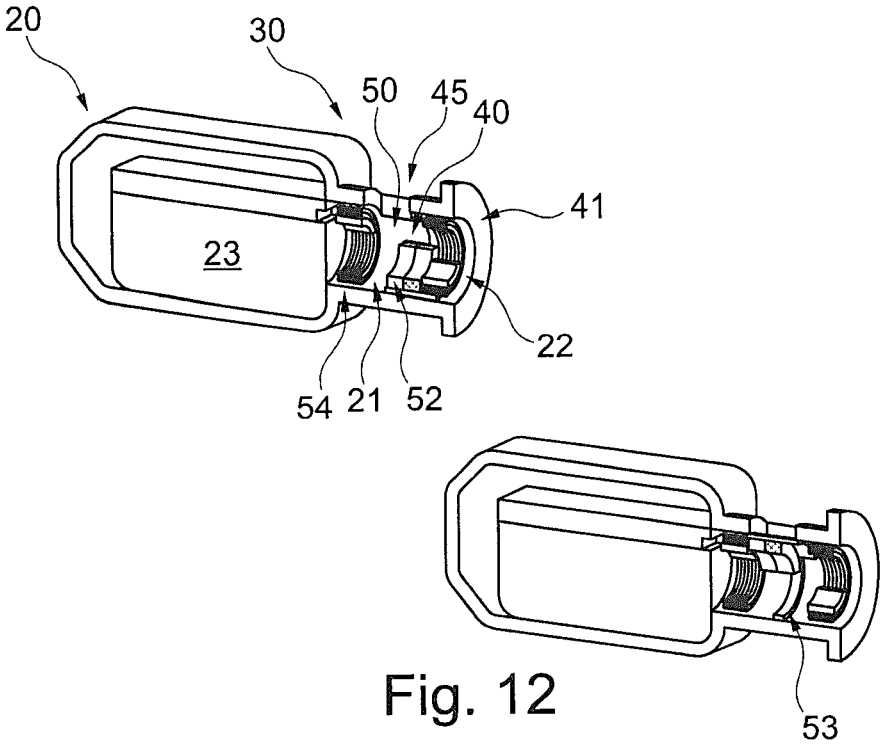
Figure 13:
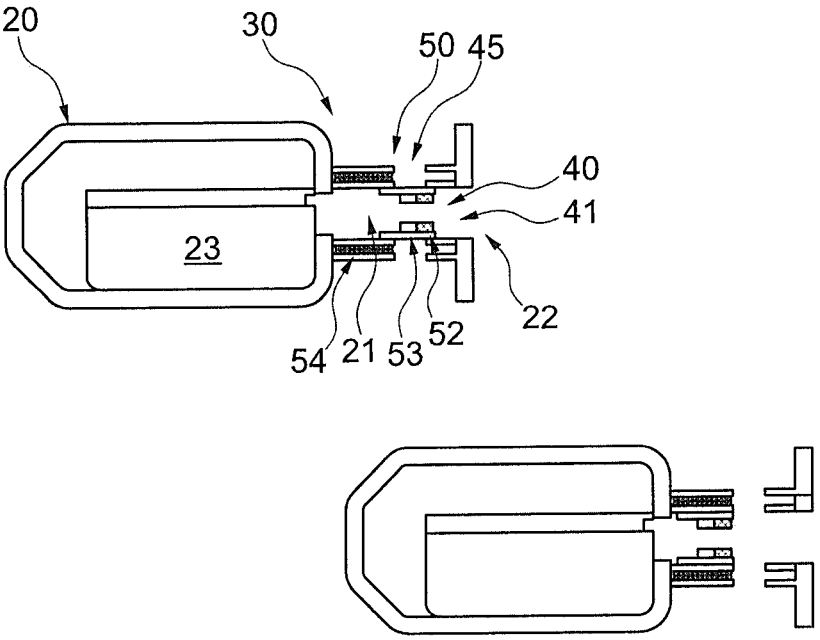
Figure 14:
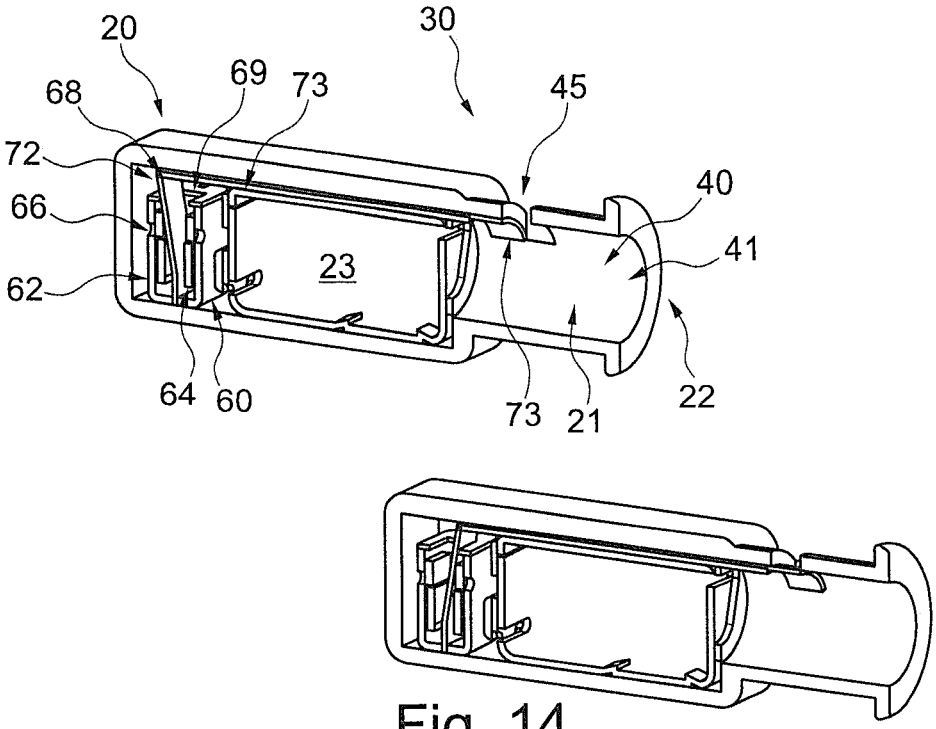
Figure 15:
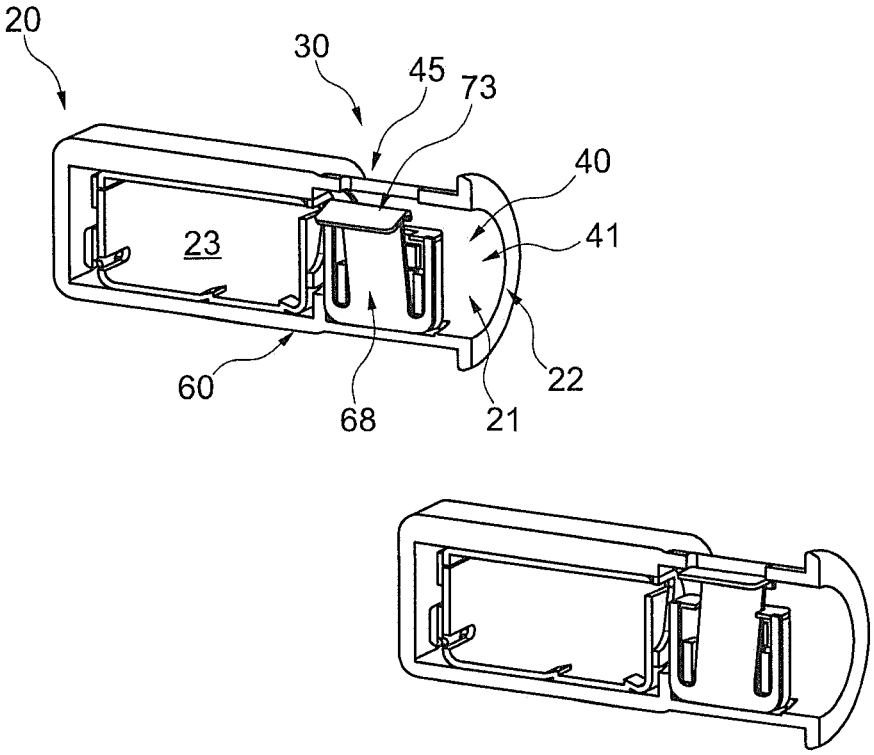
Figure 16:
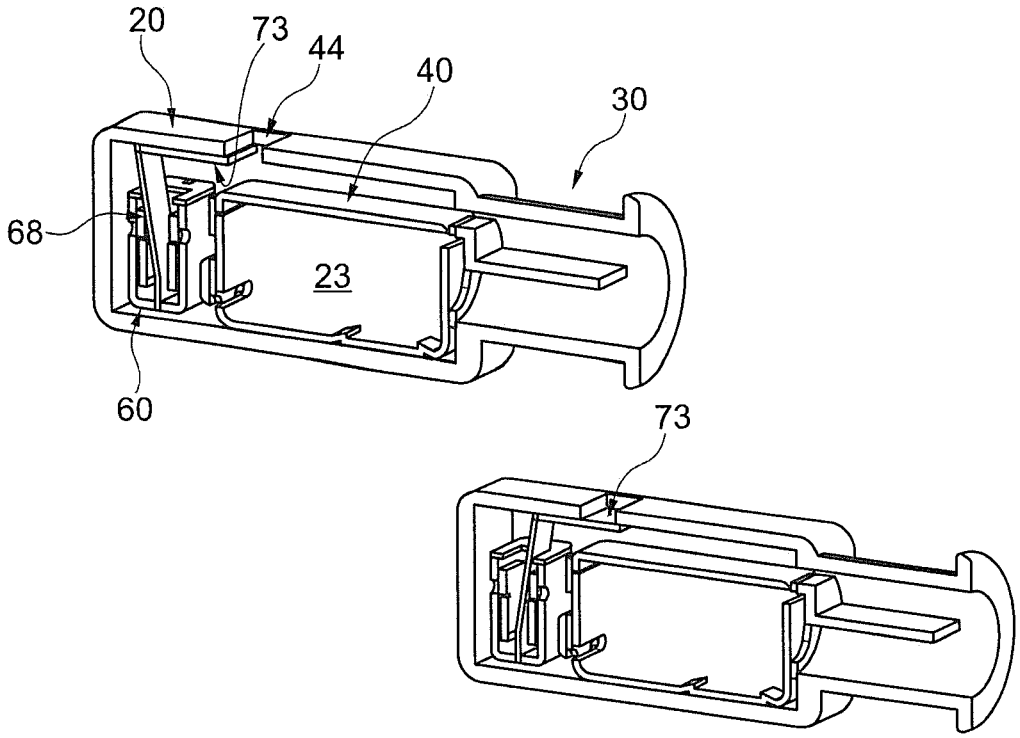
Figure 17:
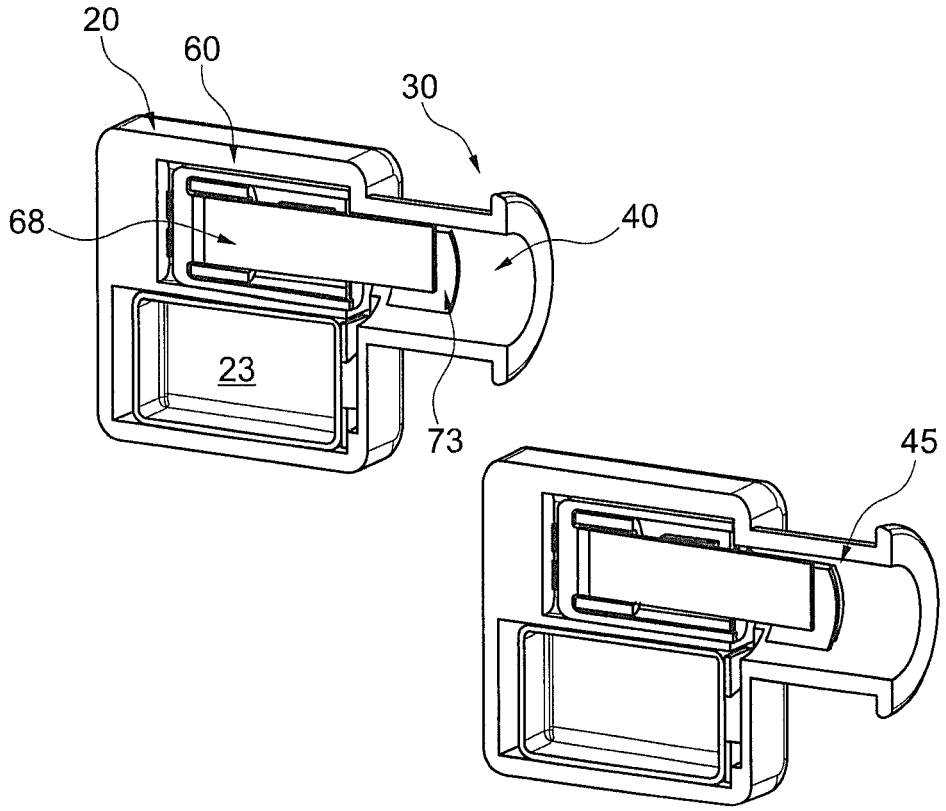
Figure 18:
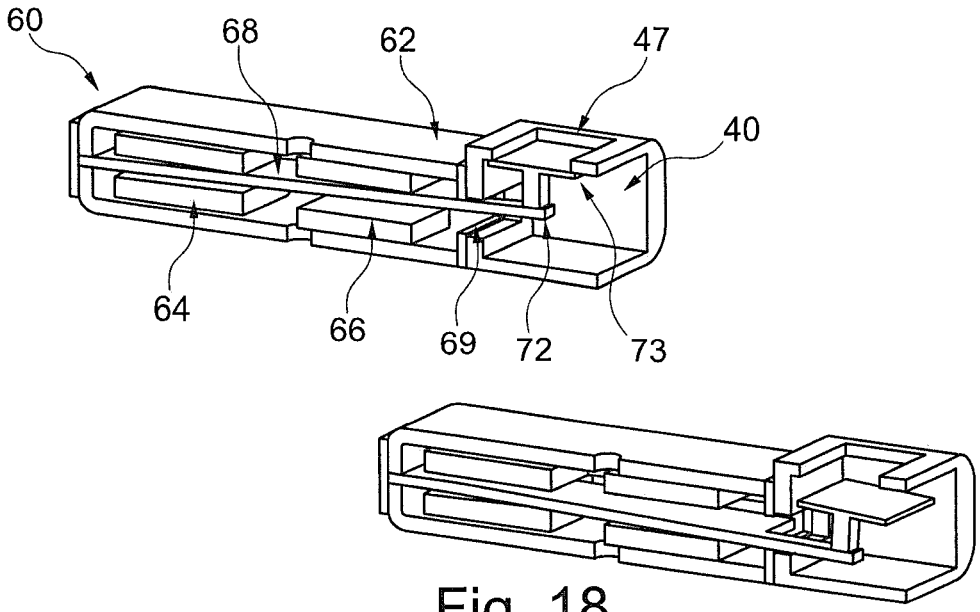
Figure 19:
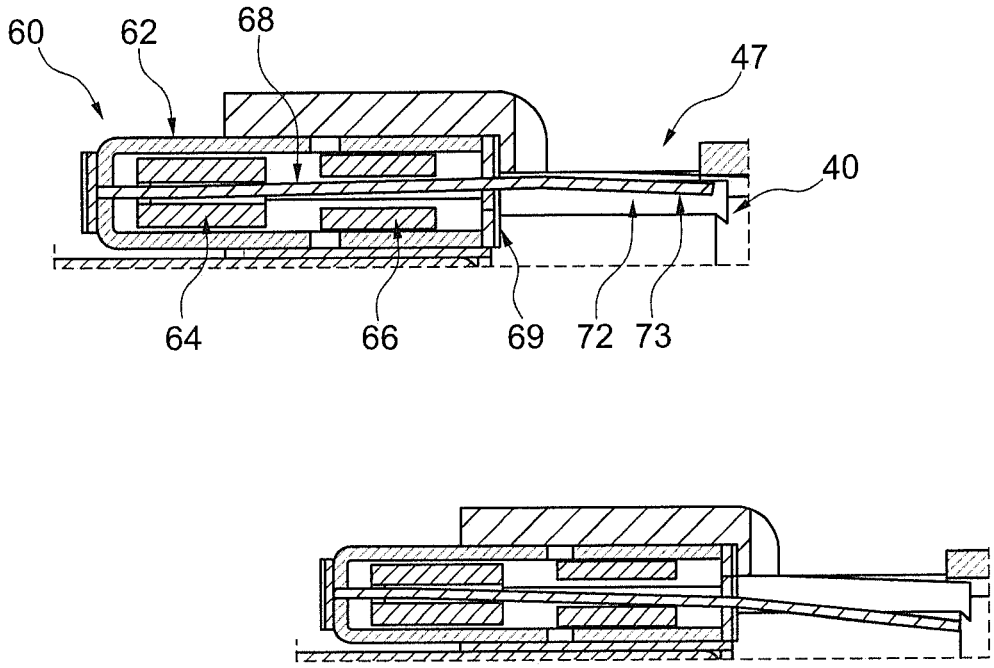
Figure 20:
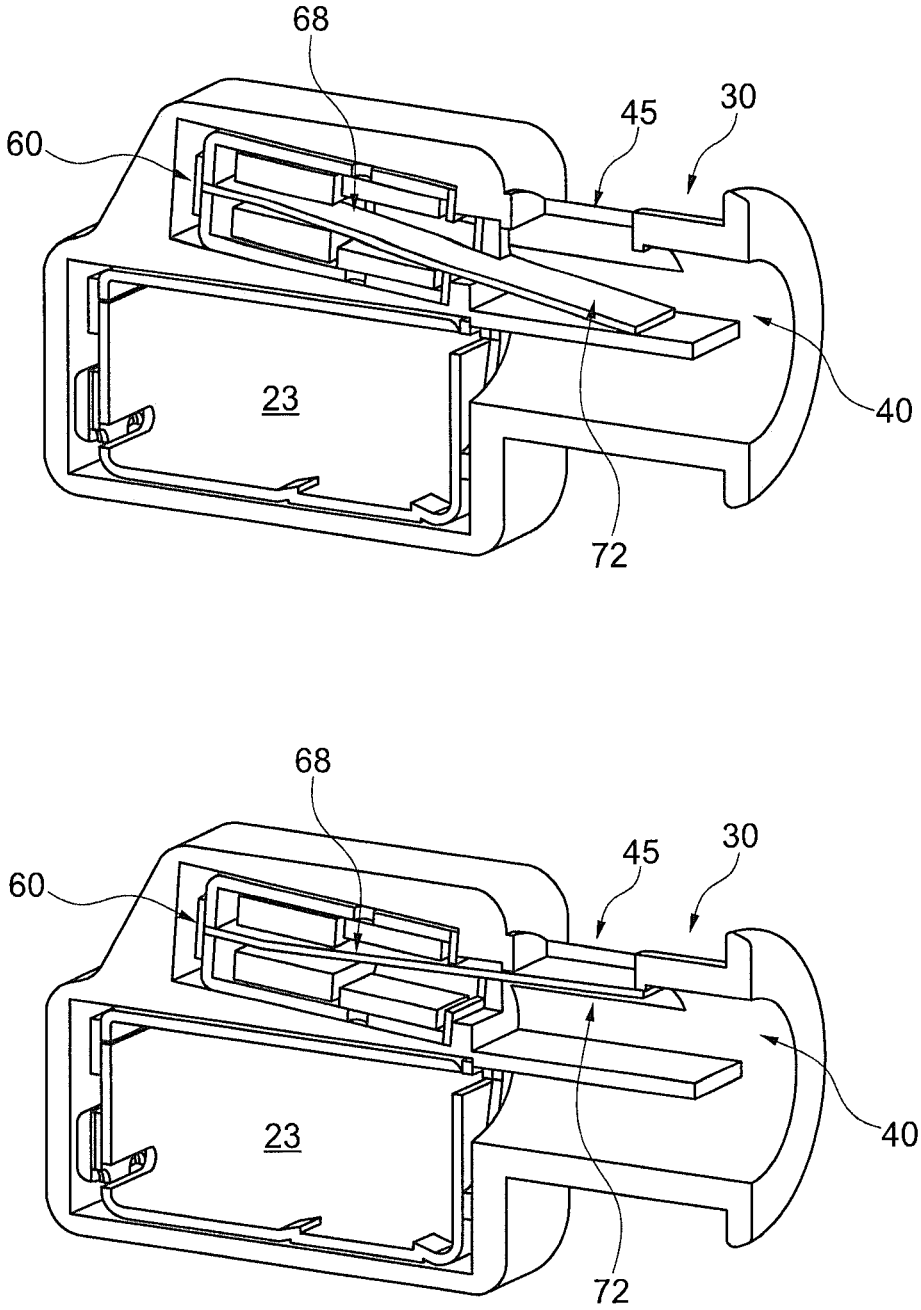
Figure 21:
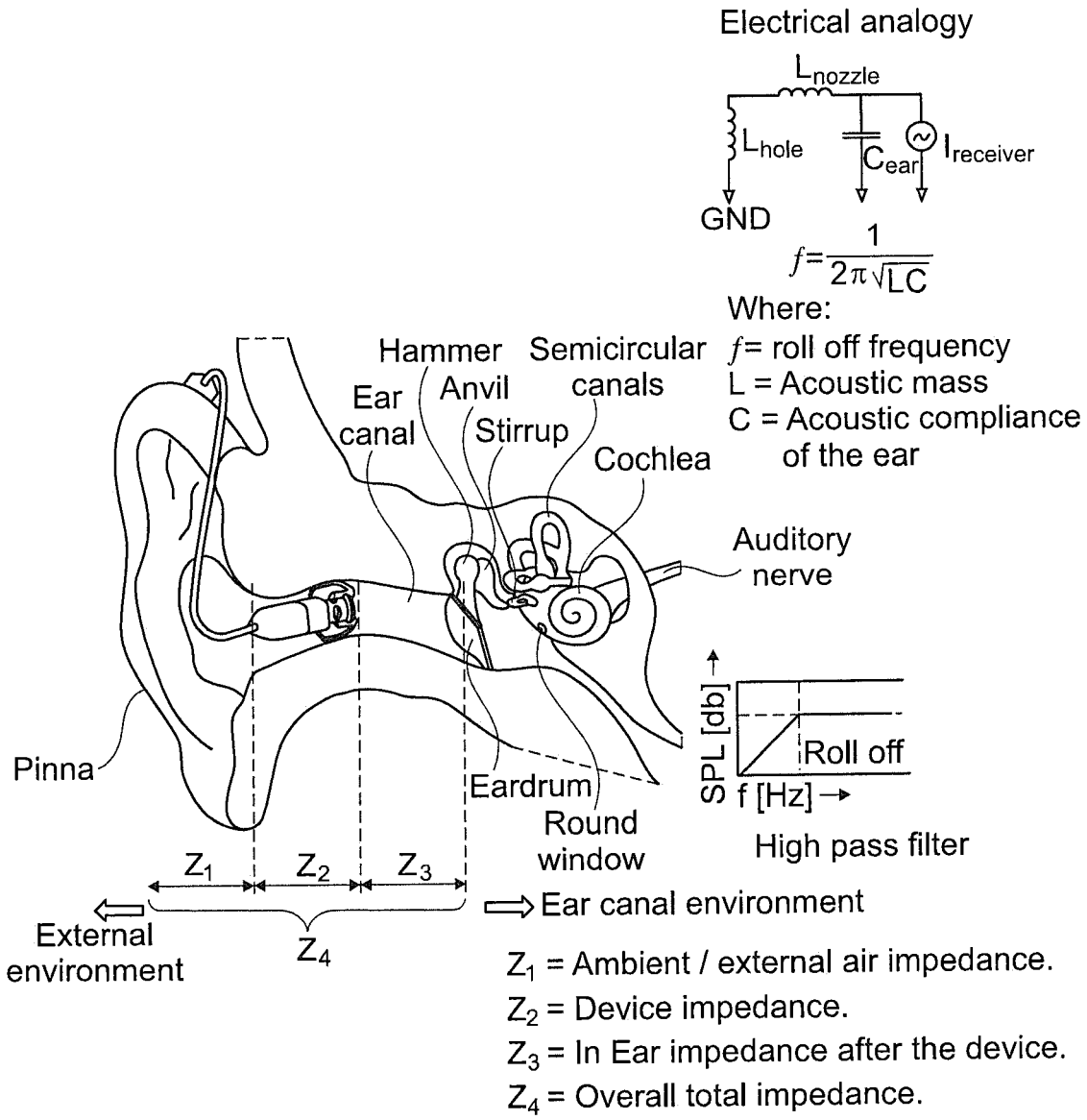

FIG. 7 illustrates a first embodiment of a valve for use in the device of the invention, FIG. 8 illustrates a second embodiment of a valve for use in the device of the invention, FIG. 9 illustrates a third embodiment of a valve for use in the device of the invention, FIG. 10 illustrates a fourth embodiment of a valve for use in the device of the invention, FIG. 11 illustrates a fifth embodiment of a valve for use in the device of the invention, FIG. 12 illustrates a sixth embodiment of a valve for use in the device of the invention, FIG. 13 illustrates a seventh embodiment of a valve for use in the device of the invention, FIG. 14 illustrates a eighth embodiment of a valve for use in the device of the invention, FIG. 15 illustrates a ninth embodiment of a valve for use in the device of the invention, FIG. 16 illustrates a tenth embodiment of a valve for use in the device of the invention, FIG. 17 illustrates a eleventh embodiment of a valve for use in the device of the invention, FIG. 18 illustrates a twelfth embodiment of a valve for use in the device of the invention, FIG. 19 illustrates a thirteenth embodiment of a valve for use in the device of the invention, FIG. 20 illustrates a seventh embodiment of the invention, FIG. 21 illustrates the overall sound channel from the surroundings to a person's eardrum via a personal hearing device, and FIG. 22 illustrates the impact of a narrowing in a sound path.

In general, when an element is positioned in an ear canal, the acoustical impedance thereof changes. This change in acoustical properties alters the filtering of the sound through the ear canal.

In general, the acoustical impedance of the ear canal is altered and is composed by the acoustical impedance of the portion of the ear and ear canal outside of the device, that of the device itself and that of the remainder of the ear canal toward the eardrum (see FIG. 21).

The overall effect of the sound path in the device is that of a low pass filter. Thus, when sound is generated by the device and launched on to the ear drum, a part of the lower frequency sound is allowed to escape through the sound path, whereby the sound experienced by the eardrum will be high pass filtered. Then, it may be desirable to actually control this high pass filtering by turning it on and off (opening and closing the sound path). In fact, it may also be desirable to be able to control the roll of frequency of the high pass filter through a control of the roll of frequency of the low pass filter created by the sound path. This may be obtained by controlling the dimensions thereof.

The following description will relate to the acoustical properties of the device and how to affect this.

In FIG. 22, the acoustical properties of a sound path, such as a sound path through a device, are illustrated and calculated. In the present example, a sound path with a circular cross section and an inner diameter (VD) of 2 mm is used as a basis.

The skilled person knows that also the length of the path is of relevance, so three different lengths (ITEL) are evaluated: 10, 16 and 22 mm.

An interesting parameter to quantify the path by is the roll of frequency, as the path will act as a low pass filter, so that the roll of frequency is the frequency at which a 3 dB loss is seen. Thus, the higher the roll of frequency, the higher frequencies are transported. Usually, the attenuation for frequencies above the roll of frequency is 12 dB per octave.

The roll of frequency is determined for the three lengths where no filter/valve is provided in the paths. Clearly, the path itself has a filtering function.

A filter is then inserted in the path in the form of a wall with a passage with an inner diameter (Vd) of 1 mm. The wall thickness has an impact on the acoustical properties of the wall, i.e. the acoustical impedance thereof, and this may be seen on the roll of frequency, which is calculated.

This filter has two components, a wall or opening thickness and a closing element also having a thickness in the direction of the sound. These elements have been combined into a single element with a thickness and an opening diameter.

It is seen that the larger the thickness of the filter, the lower the roll of frequency. Thus, the thinner the filter, the lower the impact on the sound transported by the channel.

In fact, it may be desired that the main impact on the sound is that of the sound channel and not that of the filter. When the sound channel has a fixed length, as seen in this example, the impact caused by the filter may be controlled by controlling the thickness of the filter (or the diameter thereof). It is seen that for e.g. the 16 mm path length, the roll of frequency is reduced by 20% (from 649 Hz to 520 Hz) by a filter length of 2.5 mm but only 10% (from 649 Hz to 585 Hz) by a filter length of 1 mm.

Thus, firstly, it is seen that the filtering capabilities of the sound path itself may be determined and are rather substantial even when no filter is provided in the path. Also, it is seen that even when a rather narrow opening is provided within the sound path, the impact thereof may be limited, as long as the length along which this narrowing exists, is limited. It is desired to not provide any narrower portions with a length of more than 3 mm, as this may ensure that the main filtering is caused by the remainder of the sound path, which is required under all circumstances.

Also, it is clear that it is desired to keep the overall length of the sound path down. This may be obtained by positioning the openings of the sound path as close to each other as possible. As will be described below, the openings are often positioned on either side of a blocking element, so it may be desired to not position the openings too far from the blocking element.

Figure 1:
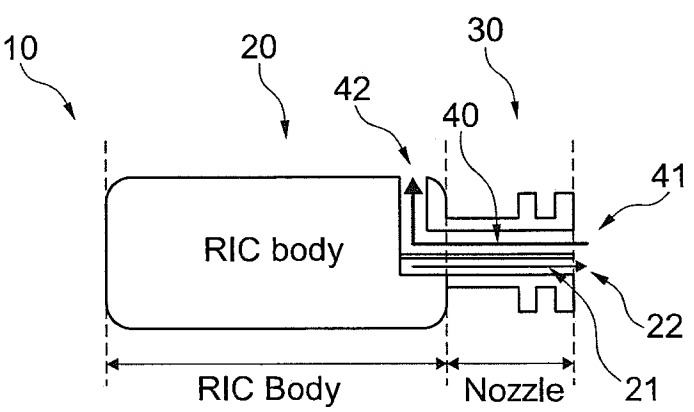
FIG. 1 illustrates a first embodiment of the invention.

In FIG. 1, relevant portions of a hearable, hearing aid or the like are illustrated having a Receiver In the Canal (RIC) 20 comprising usually a sound emitter and a nozzle or spout 30 having a channel 21 configured to receive sound from the sound emitter and launch the sound through an opening 22 and into the ear canal (green arrow).

In RICs, it is often desired to allow sound from outside of the ear (left side) to enter the ear canal (right side). Often, a RIC is made either permanently open to allow this or closed, whereby this is prevented. A few valve types are described for opening or closing this sound passage. These valves, however, are designed in a manner so that sound is hardly transported, so that the RICs are not truly open anyway.

In FIG. 1, a vent channel (red arrows) 40 is provided from opening 41 at the right side of the spout 30 and opening 42 at the side of the RIC body. Often, the RIC housing is fixed in an ear canal by a dome attached to the side of the nozzle 20 and which blocks sound passage from the left to the right side of the hearable 10 at the outside thereof and at that position. Thus, the vent channel 40 allows sound to pass the dome—but inside the spout 30.

As mentioned above, the dimensions of the vent channel 40 are important in order to truly allow sound to pass therein, but there is space in usual spouts for a channel of such dimensions.

Figure 3:
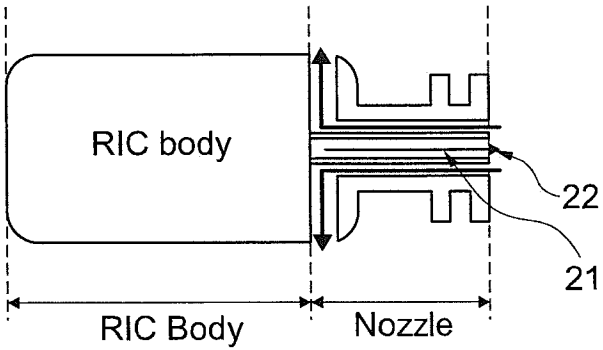
FIG. 3 illustrates a third embodiment of the invention.

In FIG. 1, a single vent channel 40 is provided. In FIG. 3, dual vent channels are provided. Naturally, this may instead be a single vent channel extending around the circumference of the sound output channel 21.

Figure 2:
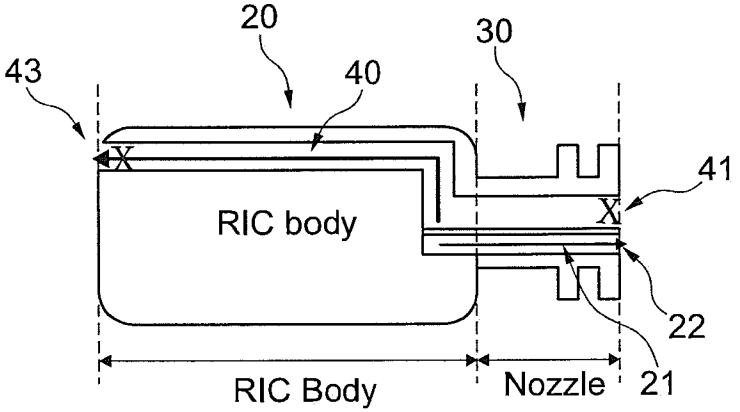
FIG. 2 illustrates a second embodiment of the invention.

In FIG. 1, the vent channel 40 opens to the side of the RIC housing just behind the dome or close to the left end of the nozzle. In FIG. 2, the vent channel 40 passes through the RIC body and to opening 43 at the left-most side thereof. In usual use scenarios, the embodiment in FIG. 2 has the left vent opening directed directly outwardly of the ear or ear canal.

The vent channel extends through the RIC housing. The vent channel may in the housing be provided as a tube or other sound guide extending around elements in the RIC housing, such as a sound emitter, any microphones, electronics, batteries and the like. Alternatively, the vent channel in the RIC housing may simply extend around such elements, so that an inner surface of the RIC housing may define a portion of the vent channel as well as outer surfaces of the elements in the RIC housing.

Figure 4:
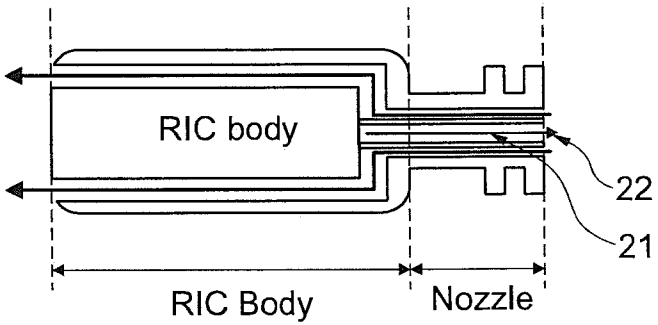
FIG. 4 illustrates a fourth embodiment of the invention.

In FIG. 2, a single vent channel is illustrated, whereas two are illustrated in FIG. 4. Providing multiple vent channels is a way of increasing the cross section of the vent channel, if it is not possible to increase the cross section of a single vent channel.

In general, the vent channel has a length between the opening 41 and the opening 42/43. The length may be determined from a cross section or may be seen as the distance actually taken by sound passing the vent. Especially when the vent channel extends through the RIC housing and around elements therein, sound may take multiple paths through the channel, so that the length may be more difficult to determine. In that situation, the length may be a smallest length, a mean length or a maximum length.

The cross sectional area of the channel may be determined in a number of manners. In one manner, the cross section of a portion of the channel is determined in a plane perpendicular to the direction of the sound in that portion. Thus, if the sound has a tortuous path, the cross section may be determined correspondingly.

If the channel has multiple channels, the cross sections of the channels are summed, as the sound has an overall wider channel to pass through.

Actually, when multiple channels are present, all channels may be controlled by one valve, or multiple valves may be provided for controlling individual channels. Thus, channels with different properties may be brought into and out of operation in order to affect the acoustical properties of the combined sound path.

Figure 5:
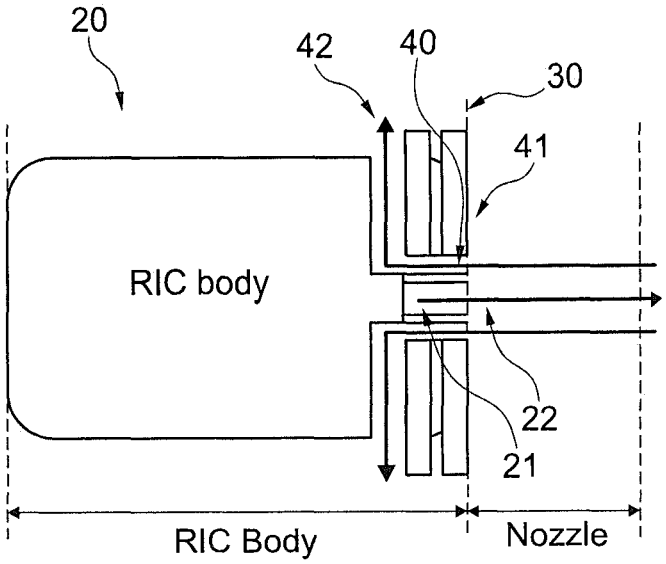
FIG. 5 illustrates a fifth embodiment of the invention.
Figure 6:
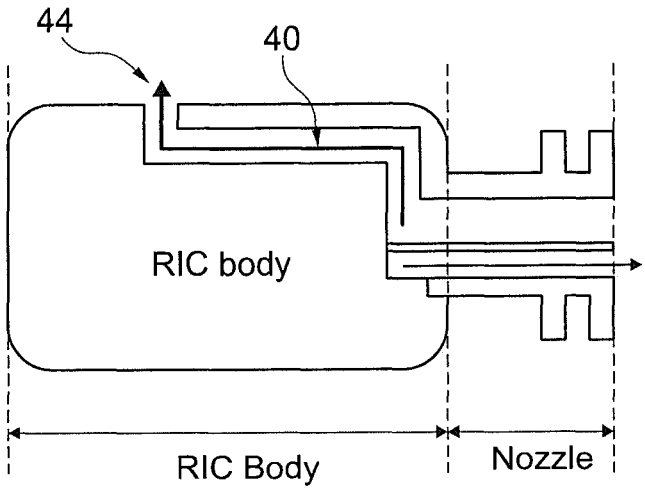
FIG. 6 illustrates a sixth embodiment of the invention.

In FIG. 5, the nozzle 30 is shorter, and in FIG. 6, the vent channel 40 has the left-most opening 44 in the top portion of the RIC housing. Naturally, the vent channel 40 may have its openings at any desired positions. Often, an ear canal blocking element is provided around the RIC/spout at a position between the openings of the vent channel, and this position may be attached to the RIC/spout at any desired position.

Thus, instead of an opening in the spout 30, the vent may have both openings in the RIC housing, such as openings 42 and 43 if desired.

In general, the sound path 21 and the vent path 40 need not be separated in the spout 30. An advantage of the separation along at least a portion of the length of the spout is that this extends the length which sound from the RIC housing must take in order to enter the vent channel 40 and thus exit the vent channel in the openings 42/43/44. Usually, sound passage in this manner is not desired, and one manner of preventing or reducing this is to separate the vent and sound passage as much as possible.

In FIG. 7, an embodiment is illustrated in which the RIC has a spout 30 with a vent channel 40 having an opening 41 in the end of the spout and a side opening 45 to the surrounding.

In the spout 30, the sound channel 21 again is separated from the vent passage by an inner tube 31.

The opening 45 is closed by a closing member or valve 50 having a magnet 52 driven by a coil 54 positioned in the spout 30. The closing member may be driven back/forth by operation of the coil. In the lower illustration of FIG. 7, the opening 45 is closed, as the coil has driven the magnet 52 further to the right.

In FIG. 7, the closing member has a sleeve 53 which may slide along the inner tube 31 to control the movement of the closing member 50. This sleeve is not required, and the magnet may itself block the opening 45 if desired.

In FIG. 7, the closing member moves away from the sound path and thus does not interfere with sound transported therein in the open state. Thus, the only portion of the valve interfering with that sound is the coil 54, which may be moulded into the outer wall in order to be fully removed from the sound path.

In FIG. 8, another embodiment is illustrated wherein the sound emitter 23 may be seen in the RIC housing 20 wherein the vent channel extends to an opening 45 (back side of the housing not illustrated). The closing member 50 again comprises a magnet 52 and a coil 54 moving the magnet. In this embodiment, the coil 54 alone blocks the opening from the spout portion of the channel 40 and that travelling in the housing 20. In this embodiment, the vent channel 40 and the sound channel 21 are not separated along the full length of the spout. As in FIG. 7, the closing member moves away from the sound path, and into a space reserved for it, in the open position. Thus, the closing member does not take up space in the sound path. It is noted that the outer surface of the coil 54 forms part of the sound path.

In FIGS. 7 and 8, the closing member is not provided in the path of the sound from the receiver 23.

In FIG. 9, an embodiment is seen wherein the closing member 50 acts in a piston-like manner to close a side opening 46 provided in the spout 30. Again, a coil 54 drives a magnet 52 between two positions where, in this embodiment, in the upper position, a closing element 55 blocks the opening 45, and in the lower position, sound is allowed to enter the opening 45.

Clearly, in the embodiments, the sound channel 21 guiding sound from the receiver 23 through the spout is never blocked by the operation or the elements of the closing member. Preferably, the length (along the spout 30) taken up by the closing member 50 is limited. The present member may be made with an outer diameter of 3 mm or less, so that the length of the sound path in which the closing member 50 is present is limited. The same is the situation for its impact on the sound from the receiver 23.

In FIG. 10, the closing member 50 again acts with a piston-like movement. Again, a magnet 54 and a coil 52 are provided but now in a different position in the passage 40, at the opening 43 at the back side of the RIC housing 20.

A dividing wall 32 is provided for, like the tube 31 described above, extend the path from the output of receiver 21 to the sound passage 40.

In FIG. 11, the same type of valve is used for an opening 44 at the top of the housing 22.

In FIGS. 10 and 22, the blocking element, as in FIG. 7, is not present at all in the open state, so that it does not interfere with the sound transported in the sound path in the open state. Naturally, the magnet 54 may extend partly into the sound path in the open position, as it will do so over a limited distance and will thereby not interfere more than a limited amount.

In FIG. 12, compared to FIG. 7, the operation of the closing member 50 is a combined rotation and translation, again caused by a coil 54 acting on a magnet 52. This time, the magnet may be attached to a sliding element 53 ensuring that the magnet is kept engaged to the inner spout wall during its movement.

In FIG. 13, a similar type of valve is seen where the coil 54 makes the magnet 52 of the closing member translate within the channel. Now, a sleeve 53 is provided for guiding the magnet. Naturally, the sleeve 53 may be omitted so that the magnet itself closes the opening 45.

In FIGS. 12 and 13, part of or the entire closing member 50 is seen in the channel carrying the sound from the receiver 23. However, as it may be provided over a limited distance along the longitudinal direction of the spout, the impact thereof is limited. Also, in these embodiments, the closing member 50 is provided at the outer periphery of this channel and has a central channel always open to the sound from the receiver 23.

In FIGS. 7-13, a closing member 50 based on a moving magnet concept has been used for opening/closing the vent channel 40. In some embodiments it has been positioned to simply block the channel 40 and in others it has been positioned in the sound output channel 21 and thus is to block an opening or a portion of the channel 40 while not blocking the sound output channel 21. Some of the designs are co-axial designs where the driver or actuator has a circular or ring-shaped design which is always open at a centre, so that sound may always travel through the actuator independently of whether it closes the channel 40 or allows it to be open.

In the below figures, another type of actuator is provided for the purpose of opening/closing the channel 40.

In FIG. 14, an actuator 60 is illustrated having a housing 62 with an opening 69. In the housing 62, an armature is provided having a deflectable armature leg 68 extending through a coil tunnel in a coil 64 and a magnet gap in a magnet system 66. The operation of the armature may be as that of balanced armature receivers or the valves seen in US2017/0208382, US2016/0255433 and EP3177037, where the armature leg conducts a magnetic field generated by the coil into the magnet gap, where the armature leg is exposed to the magnetic field deflecting the armature leg from side to side. In usual receivers, the deflection mirrors the current in order to generate sound, but in the present context, the armature movement is used for opening/closing a valve, so the signal fed to the coil usually is a constant current or a current exceeding or being below a threshold, so that the armature is positioned in an upper or a lower position for opening/closing of the valve.

In some embodiments, the actuator is mono stable so that if no current is fed to the coil, the armature leg is biased toward a stable position, such as the lower or upper position. When a current fed to the coil exceeds a predetermined threshold, the force exerted to the armature leg may overcome the biasing and thus bring the armature leg to the other position. In this type of situation, the armature may be positioned at an angle so that the leg, when not affected by a magnetic field (the current fed to the coil is zero), is in the first position.

In another situation, the leg may be biased by any desirable biasing element, such as a magnetic/electric field, a spring or the like, toward the first position.

A bi stable actuator may be obtained when the armature leg, when touching the inner surface of the magnet gap at the upper and lower position, will be attracted to the magnet system to a degree overcoming any biasing caused by the deflection of the armature leg. Thus, when the leg is in the upper or lower position, it will stay in that position until an additional force, created by the magnetic field caused by a current fed to the coil, overcomes this attraction and forces the armature leg into the other position, where the leg again touches the magnet system and thus again is in a stable position.

Alternatively, of course, the actuator need not have any stable modes in the cuter positions but require the feeding of a current to obtain both of these outer positions.

The armature and coil/magnet systems are provided in a housing 62 having an opening 69 from which a portion 72 of the armature leg 68 extends. Preferably, the housing 62 has no other opening than the opening 69, or at least no other opening suitable for transporting sound in the audible frequency range of 20 Hz-20 kHz—or at least in the interval of 700 Hz-2000 Hz. Openings of this type preferably have a cross sectional area of 0.05 $mm^2$ or more.

The portion 72 drives an elongate portion 73, via a hinge, so that when the armature portion 68 is in one extreme, the portion 73 is in one extreme position, and vice versa.

In the spout 30, a side opening 45 exists which is blocked by the portion 73 in the right illustration but kept open in the left illustration. Thus, a valve is created opening and closing the side opening 45 using the element 73. The element 73 may be made of the same material as the armature leg 68 or may be made of another material, such as a lighter material, a material not easily transporting a magnetic field, and/or a material providing a desired sealing to the element creating the aperture. Also, the material of the portion 73 may be selected to not provide a sound or vibration when colliding with the element forming the aperture when closing the aperture.

In FIG. 14, only a small portion of the elements 72/73 is provided in the spout and none of these will interfere with the sound in the sound channel but they may be "seen" by the sound from the receiver 23. This impact, however, is minimal, as they are provided at the inner periphery of the sound channel, close to the emitter output and only for a very limited distance.

In FIG. 15, another embodiment of a transducer is seen having the housing 20 in which the receiver 23 is positioned together with a valve 70 now positioned in the spout 30 but still having an armature leg 68 and a closing element 73 closing, in the right illustration, a side opening 45 in the spout 30 and allowing the opening, in the left illustration, to be open. Only the most relevant parts of the valve and driver are illustrated.

In this embodiment, the driver or valve 60 is positioned in the spout 30. However, this element may be made so slim that sound output by the receiver 23 may travel around the driver 60 and out of the spout 30.

The deflection of the armature leg 58 is into and out of the plane of the drawing. Thus, the closing element 73 may simply be an extension of the armature leg 68, which extension is shaped to conform to the portion of the spout defining the aperture so as to be able to close the aperture when desired.

The driver 60, in FIG. 15, is provided to interfere with the sound both from the opening 45 and the receiver 23. However, as it may be designed to take up only a small distance along the longitudinal direction of the spout, its impact on this sound is acceptable.

In FIG. 16, a top opening 44 is closed by a closing element 73 driven by a balanced armature driver 60 having an armature leg 68 extending outside of the housing 62 and hingedly engaging the element 73. Again, the vent passage 40 extends from the spout (may be omitted) and inside the housing 20. The outer surface of the receiver 23 defines a portion of the passage wall, but the passage 40 could alternatively be provided as a tube between the opening 44 and the opening into the spout.

Again, the valve is positioned to neither interfere with the sound of the receiver 23 and that from the opening 44.

In FIG. 17, the actuator 60 has been rotated so that the flexing of the armature 68 now opens or closes the side opening 45 using the element 73. Clearly, the actuator 60 and receiver 23 may be oriented as desired in the housing 20 in order to open/close openings at any positions and so as to allow the housing 20 to have any desired shape for use in different positions at/in an ear or ear canal.

the portion 73 is designed to not interfere excessively with the sound output of the receiver 23, as it has a limited length along the longitudinal direction of the spout and as it extends more or less in the direction of the spout and thus of the sound.

In general, a wide variety of positions, orientations and elements may be used.

In one embodiment, the element 73 is wider than the armature 68. In this manner, the armature 68 may be made rather thin to even better prevent sound from entering the housing of the actuator 60. Also or alternatively, the portion 73 may be shaped to fit any opening shape, position and orientation independently of a cross section of the armature. As mentioned, the portion 73 may even be made of another material than the armature 68 if desired.

In FIGS. 18 and 19, other valve embodiments are illustrated which may be used for blocking or opening a vent passage (not illustrated). Both embodiments are based on the balanced armature 60 with a housing 62, a coil 64, a magnet system 66, a deflectable armature leg 63 with a portion 72 extending cut of an opening 69 in the housing. In FIG. 18, the portion 72 is attached to a portion 73 configured to close the opening 47. In FIG. 19, the portion 72 closes the opening 47.

In FIGS. 18 and 19, the vent passage is not illustrated, but it extends through the opening 47 and preferably not into the housing 62. Thus, the valves of FIGS. 18 and 19 are simple valves which only have a small element in the actual vent passage and which do therefore not interfere unnecessarily with the sound in the vent passage. The vent passage may be dimensioned in any desired manner outside of the area around the opening 47.

Ever though a narrow opening in an element across a sound passage may not filter the sound that much, if the element is very thin, it is desired that the opening provided by the valve is rather large. Clearly, the moving magnet set-ups may in principle move the magnet any desired distance and thus open/close an opening of any size. Also, the moving armature set-ups may open/close an opening of any size, and the translation/rotation of the closing element may be over any distance, which may be defined by the distance from the armature leg to the opening.

The "thin" set-ups are achieved, as the narrowing created by the valve in the open configuration has a small extend in the direction of the sound. Preferably, any portions of the valve present in the sound path will be present within a total distance, along the path of the sound, of 3 mm or less.

One manner of obtaining a large opening with a moving armature set-up is seen in FIG. 20, where the actuator 60 is angled in relation to the receiver 23. When the armature is allowed to deflect a larger angle, the angling of the actuator 60 allows it to still close an opening parallel with a plane of the receiver 23 and, in the open state, have the portion 72 a large distance from the opening 45.

Naturally, the vent channel may be closed using any technology and in any manner. The opening/closing elements of the above description may be driven by any type of technology, such as a linear actuator, hydraulics, deformable elements as piezo elements or the like.

An alternative to closing an opening in the passage by an element is to deform the passage, such as if a portion thereof is embodied as a deformable or soft tube. Such deformation again may be caused by any technology, such as the above-described.

The overall acoustic properties of the vent passage are defined not only by those of the vent but also those in other portions of the device. However, making the vent acoustically advantageous, such as by having a large opening cross section when open, and when not causing a narrowing of a too long portion of the vent channel length, the valve is especially suitable for vent passages with desirable acoustic properties.

The vent passage may be formed in the spout and/or the device housing. The passage may be provided with the desired cross sectional properties by shaping it in relation to its surroundings. A sound passage may be wide in one direction and narrow in a direction perpendicular thereto—or it may be circular in cross section, without it interfering fatally with the acoustic properties. Also, multiple passages may be provided if desired for all of or a part of the length of the acoustic channel. The channel may extend through a housing with electronic or acoustic elements and may be defined by the inner surface of the housing and cuter surfaces of the electronic/acoustic elements.

A filter may be provided, such as for preventing foreign objects, such as dust and ear wax, from entering or blocking the sound path. Such filters often are embodied as open foams (such as with a ppi of 50-200), grids, flap or cover such as with side openings, or the like. This filter may be provided in any portion of the sound path but is preferably provided in or at an opening thereof to the surroundings, such as the opening 42/43/44/45 or the opposite opening 41 (see the X'es in FIG. 2).

The invention claimed is:

1. A personal hearing device comprising:

an outer housing, a sound path in the outer housing, the sound path extending through the outer housing from a first opening to a second opening, a valve including a closing element configured to be sequentially in two positions, where, in a first of the two positions, the closing element leaves open the first opening, the second opening, and the sound path, and, in a second of the two positions, the closing element blocks one or more of the group consisting of the first opening, the second opening, and the sound path, where: the sound path has a length of 1-12 mm and a cross section of 0.28-10 $mm^2$ and a roll off frequency of at least 500 Hz, and the valve includes an actuator for driving the closing element between the first and second positions, at least a portion of the actuator being positioned outside of the sound path.

2. A device according to claim 1, wherein the valve is configured to open and close an aperture in the sound path, the aperture having a cross sectional area of at least 1 $mm^2$.

3. A device according to claim 1, wherein any portions of the valve positioned in the sound path comprise two extreme parts being the parts of the portions in the sound path with the largest distance between them, the largest distance being 3 mm or less.

4. A device according to claim 1, further comprising a sound emitter in the outer housing, the outer housing having a sound output configured to output sound from the sound emitter.

5. A device according to claim 4, wherein the outer housing comprises a sound output element configured to receive sound from the sound emitter, wherein the sound output element forms part of the sound path.

6. A device according to claim 4, wherein the sound output element has an opening, forming the second opening, toward the surroundings and a vent opening to a portion of the sound path.

7. A device according to claim 4, wherein the sound emitter has an outer surface defining at least a part of the sound path.

8. A device according to claim 4, wherein the valve comprises an actuator for driving the closing element between the first and second positions, the actuator being positioned, when projected on to a straight line through the sound emitter and the sound output, between the sound emitter and the sound output.

9. A device according to claim 1, wherein an inner surface of the outer housing defines at least a part of the sound path.

10. A device according to claim 1, wherein the sound path comprises:

a first sound path part extending in a first direction and a second sound path part extending in a second direction, the second direction being at an angle to the first direction, where the valve has a closing element configured to be moved from a first position in which the closing element is adjacent to a wall portion of the second sound path and a second position where the closing portion blocks the first sound path.

11. A device according to claim 10, wherein the closing element in the first position is positioned in the wall portion of the second sound path.

12. A device according to claim 1, further comprising a fixing element attached to the outer housing or sound outputting element at a predetermined position, where the first opening is on one side of the predetermined position and the second opening is on an opposite side of the predetermined position.

13. A device according to claim 1, wherein, in the first position, the valve attenuates no frequency within the interval of 700-2000 Hz is attenuated more than 3 dB.

14. A device according to claim 1, wherein, in the second position, a cross sectional area of any opening between the closing element and the blocked one more of the group consisting of the first opening, the second opening and the sound path is no more than 0.157 $mm^2$.

15. A device according to claim 1, wherein, in the second position, attenuates all frequencies within the interval of 700-2000 Hz at least 3 dB.

16. A valve for a personal hearing device having an outer housing, a sound path in the outer housing, the sound path extending through the outer housing from a first opening to a second opening, the valve being configured to open and close one or more of the group consisting of the first opening, the second opening, and the sound path, the sound path having a length of 1-24 mm, a cross section of 0.28-19.6 $mm^2$, and a roll off frequency of at least 500 Hz, the valve comprising:

a closing element configured to be sequentially in two positions, where, in a first position, the closing element leaves the first opening, the second opening and the sound path, open and, in the second position, the closing element blocks one or more of the group consisting of the first opening, the second opening and/or the sound path.

17. A valve according to claim 16, wherein the valve is configured to open and close an aperture in the sound path, the aperture having a cross sectional area of at least 1 $mm^2$.

18. A valve according to claim 16, wherein any portions of the valve positioned in the sound path include two extreme parts being the parts of the portions in the sound path with the largest distance between them, the largest distance being 3 mm or less.

* * * * *